US011844385B2

(12) United States Patent
Nordstrom et al.

(10) Patent No.: US 11,844,385 B2
(45) **Date of Patent: *Dec. 19, 2023**

(54) ARTICLES OF APPAREL PROVIDING ENHANCED BODY POSITION FEEDBACK

(71) Applicant: NIKE, Inc., Beaveron, OR (US)

(72) Inventors: Matthew D. Nordstrom, Portland, OR (US); Susan L. Sokolowski, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 244 days.

This patent is subject to a terminal disclaimer.

(21) Appl. No.: 17/096,647

(22) Filed: Nov. 12, 2020

(65) Prior Publication Data

US 2021/0059334 A1 Mar. 4, 2021

Related U.S. Application Data

(60) Continuation of application No. 15/728,788, filed on Oct. 10, 2017, now Pat. No. 10,863,782, which is a (Continued)

(51) Int. Cl.
*A41D 31/18* (2019.01)
*A41D 13/00* (2006.01)

(52) U.S. Cl.
CPC ..... *A41D 31/185* (2019.02); *A41D 13/0015* (2013.01)

(58) Field of Classification Search
CPC ... A41D 31/185; A41D 13/0015; A41D 31/02
See application file for complete search history.

(56) References Cited

U.S. PATENT DOCUMENTS 907,050 A 12/1908 Hestness
1,112,387 A 9/1914 Schneer
(Continued)

FOREIGN PATENT DOCUMENTS

CA 2584636 A1 4/2006
DE 20300208 U1 3/2003
(Continued)

OTHER PUBLICATIONS

Mizuno Feb. 23, 2006 Press Release that appears to relate to its "Arch Hammock" Golf Sock product (2 pages).
(Continued)

*Primary Examiner* — Alissa L Hoey
(74) *Attorney, Agent, or Firm* — Banner & Witcoff, Ltd.

(57) ABSTRACT

Articles of apparel include: (a) a garment structure having one or more fabric elements structured and arranged to provide a close fit to at least one predetermined portion of a body (e.g., area(s) of the body for which enhanced position sensing and/or feedback are desired); and (b) a body position feedback system engaged with or integrally formed as part of the garment structure. The body position feedback system may apply higher tensile or constricting (compressive) forces to selected portions of the wearer's body and/or stretch resistance, which can help stimulate or interact with nerves and deep tissue receptors located in various portions of the body. The increased forces at selected locations of the body give the wearer sensory feedback regarding the position or orientation of these parts of the body and can improve or accelerate development of "muscle memory."

18 Claims, 16 Drawing Sheets

Related U.S. Application Data division of application No. 14/196,496, filed on Mar. 4, 2014, now Pat. No. 9,814,273, which is a continuation of application No. 13/679,641, filed on Nov. 16, 2012, now Pat. No. 8,677,512, which is a division of application No. 12/277,914, filed on Nov. 25, 2008, now Pat. No. 8,336,118, which is a continuation-in-part of application No. 11/756,291, filed on May 31, 2007, now Pat. No. 7,934,267.

(56) References Cited

U.S. PATENT DOCUMENTS 1,373,211 A 3/1921 Frederick
1,465,970 A 8/1923 Cleveland et al.
1,544,934 A 7/1925 Prankard
1,811,786 A 6/1931 Frei
1,899,092 A 2/1933 Hogan
1,980,486 A 11/1934 King et al.
1,999,929 A 4/1935 Hearn
2,102,368 A 12/1937 Martel
2,179,124 A 11/1939 Jesnig
2,219,235 A 10/1940 Morton
2,293,714 A 8/1942 Craig et al.
2,334,206 A 11/1943 Knohl
2,632,894 A 3/1953 Louis
2,831,196 A 4/1958 Scheiber
2,837,748 A 6/1958 Manning et al.
2,845,723 A 8/1958 Arnold
2,926,433 A 3/1960 Kramer
2,994,322 A 8/1961 Cullen et al.
3,015,943 A 1/1962 Loizillon
3,049,120 A 8/1962 Edith
3,124,945 A 3/1964 Moretta
3,298,036 A 1/1967 Chalfin
3,338,776 A 8/1967 Blair
3,350,100 A 10/1967 Carmines
3,526,229 A 9/1970 Blair
3,537,281 A 11/1970 Harrington et al.
3,554,190 A 1/1971 Kaplan
3,823,712 A 7/1974 Morel
3,894,542 A 7/1975 Sacristan
4,089,064 A 5/1978 Chandler, Jr.
4,222,569 A 9/1980 DeMascolo
4,322,894 A 4/1982 Dykes
4,519,148 A 5/1985 Sisco
4,625,336 A 12/1986 Derderian
4,644,940 A 2/1987 Nakamura
4,670,913 A 6/1987 Morell et al.
4,698,847 A 10/1987 Yoshihara
4,706,524 A 11/1987 Fischer et al.
4,728,538 A 3/1988 Kaspar et al.
4,730,625 A 3/1988 Fraser et al.
4,862,523 A 9/1989 Lipov
4,946,453 A 8/1990 Monson
5,007,412 A 4/1991 DeWall
5,009,420 A 4/1991 Martelli
5,088,728 A 2/1992 Deden
5,103,656 A 4/1992 Hanson, II
5,109,546 A 5/1992 Dicker
5,176,600 A 1/1993 Wilkinson
5,179,942 A 1/1993 Drulias et al.
5,257,969 A 11/1993 Mance
5,263,923 A 11/1993 Fujimoto
5,282,277 A 2/1994 Onozawa
5,337,418 A 8/1994 Kato et al.
5,351,340 A 10/1994 Aldridge
5,367,708 A 11/1994 Fujimoto
5,402,742 A 4/1995 Kiaulehn
5,410,755 A 5/1995 Obujen
5,412,957 A 5/1995 Bradberry et al.
5,445,598 A 8/1995 Nguyen-Senderowicz
5,445,601 A 8/1995 Harlow
5,465,428 A 11/1995 Earl
5,472,414 A 12/1995 Detty
5,473,781 A 12/1995 Greenberg
5,536,246 A 7/1996 Saunders
5,537,690 A 7/1996 Johnson
5,582,583 A 12/1996 Ballantyne
5,591,122 A 1/1997 Yewer, Jr.
5,603,232 A 2/1997 Throneburg
5,606,745 A 3/1997 Gray
5,611,084 A 3/1997 Garry et al.
5,617,745 A 4/1997 Della Corte et al.
5,620,413 A 4/1997 Olson
5,638,548 A 6/1997 Kawakami
5,640,714 A 6/1997 Tanaka
5,640,719 A 6/1997 Ritchie
5,659,895 A 8/1997 Ford, Jr.
5,699,559 A 12/1997 Sano
5,706,524 A 1/1998 Herrin et al.
5,708,976 A 1/1998 Dicker
5,708,985 A 1/1998 Ogden
5,782,790 A 7/1998 Allen
5,792,034 A 8/1998 Kozlovsky
5,799,328 A 9/1998 Harlem et al.
5,823,886 A 10/1998 Murray
5,823,980 A 10/1998 Kopfer
5,842,959 A 12/1998 Wilkinson
5,857,947 A 1/1999 Dicker et al.
5,913,592 A 6/1999 Moore
5,928,173 A 7/1999 Unruh
5,937,442 A 8/1999 Yamaguchi et al.
5,960,474 A 10/1999 Dicker et al.
5,960,565 A 10/1999 Lochbaum
5,978,965 A 11/1999 Summers
5,996,120 A 12/1999 Balit
6,006,363 A 12/1999 Karlin
6,018,888 A 2/2000 Wilkenfeld et al.
6,047,406 A 4/2000 Dicker et al.
6,061,832 A 5/2000 Morrison, Jr.
6,068,606 A 5/2000 Castel et al.
6,076,187 A 6/2000 Wallerstein
6,076,284 A 6/2000 Terlizzi
6,080,038 A 6/2000 Sano
6,082,146 A 7/2000 Dahlgren
6,086,551 A 7/2000 Allen
6,092,397 A 7/2000 Cortinovis
6,142,967 A 11/2000 Couch
6,146,240 A 11/2000 Morris
6,176,816 B1 1/2001 Dicker et al.
6,178,781 B1 1/2001 Myers
6,186,970 B1 2/2001 Fujii et al.
6,192,519 B1 2/2001 Coalter
6,195,801 B1 3/2001 Meyers
6,231,488 B1 5/2001 Dicker et al.
6,260,201 B1 7/2001 Rankin
6,279,164 B1 8/2001 Martin
6,286,151 B1 9/2001 Lambertz
6,314,580 B1 11/2001 Greenberg et al.
6,336,227 B1 1/2002 Liput et al.
6,364,851 B1 4/2002 Nafpliotis
6,375,581 B1 4/2002 Urban et al.
6,430,752 B1 8/2002 Bay
6,430,753 B2 8/2002 Duran
6,454,628 B1 9/2002 Shunichirou
6,520,926 B2 2/2003 Hall
6,539,551 B1 4/2003 Jones, Jr.
6,546,560 B2 4/2003 Fusco et al.
6,620,026 B1 9/2003 Guilani et al.
6,623,419 B1 9/2003 Smith et al.
6,641,550 B1 11/2003 Johnson
6,675,391 B2 1/2004 Morrison
6,684,410 B2 2/2004 Robinett et al.
6,700,031 B1 3/2004 Hahn
6,708,348 B1 3/2004 Romay
6,719,712 B2 4/2004 Zigmont
6,799,331 B2 10/2004 Griesbach, III et al.
6,800,063 B2 10/2004 Iwata
6,805,681 B2 10/2004 Yokoyama
6,862,820 B2 3/2005 Farys et al.
6,908,445 B2 6/2005 Watts
7,082,703 B2 8/2006 Greene et al.
7,087,032 B1 8/2006 Ikeda
7,117,538 B2 10/2006 Bosne et al.

(56) References Cited

U.S. PATENT DOCUMENTS

| | | | | |
|---|---|---|---|---|
| 7,169,249 | B1 | 1/2007 | Nordstrom | |
| 7,192,411 | B2 | 3/2007 | Gobet et al. | |
| 7,225,472 | B2 | 6/2007 | McDonald, Jr. et al. | |
| 7,241,252 | B1 | 7/2007 | Gagliardi | |
| 7,243,444 | B2 | 7/2007 | Selner | |
| 7,246,381 | B2 | 7/2007 | Green | |
| 7,322,050 | B2 | 1/2008 | Heatherly | |
| 7,395,557 | B1 | 7/2008 | Ledyard | |
| 7,559,093 | B2 | 7/2009 | Sudo et al. | |
| 7,562,541 | B2 | 7/2009 | Hermanson et al. | |
| 7,614,257 | B2 | 11/2009 | Araki et al. | |
| 7,631,367 | B2 | 12/2009 | Caillibotte et al. | |
| 7,669,250 | B2 | 3/2010 | Baron et al. | |
| 7,748,056 | B2 | 7/2010 | Mickle | |
| 7,871,388 | B2 | 1/2011 | Brown | |
| 7,886,367 | B2 | 2/2011 | Chapuis et al. | |
| 7,913,323 | B2 | 3/2011 | Takamoto et al. | |
| 7,934,267 | B2 | 5/2011 | Nordstrom et al. | |
| 7,971,280 | B2 | 7/2011 | Kaneda | |
| 7,996,924 | B2 | 8/2011 | Wright et al. | |
| 8,007,457 | B2 | 8/2011 | Taylor | |
| 8,336,118 | B2 | 12/2012 | Nordstrom et al. | |
| 8,341,772 | B1 | 1/2013 | Flores | |
| 8,375,468 | B2 | 2/2013 | Okamoto et al. | |
| 8,516,616 | B2 | 8/2013 | Nordstrom et al. | |
| 8,533,864 | B1 | 9/2013 | Kostrzewski | |
| 8,677,512 | B2 | 3/2014 | Nordstrom et al. | |
| 8,823,863 | B2 | 9/2014 | Hasegawa | |
| 8,951,136 | B1 * | 2/2015 | Booher ..... | A63B 69/0059 473/215 |
| 9,009,863 | B2 | 4/2015 | Decker | |
| 9,345,275 | B2 | 5/2016 | Albin et al. | |
| 9,814,273 | B2 | 11/2017 | Nordstrom et al. | |
| 9,895,569 | B2 | 2/2018 | Yao | |
| 10,265,564 | B2 | 4/2019 | Kehler et al. | |
| 10,271,581 | B2 | 4/2019 | Kehler et al. | |
| 10,575,569 | B2 | 3/2020 | Montoya et al. | |
| 2001/0041855 | A1 | 11/2001 | Voskuilen | |
| 2002/0029409 | A1 | 3/2002 | Coccia | |
| 2002/0078591 | A1 | 6/2002 | Morrone | |
| 2002/0169403 | A1 | 11/2002 | Voskuilen | |
| 2003/0028952 | A1 | 2/2003 | Fujii et al. | |
| 2003/0041364 | A1 | 3/2003 | Donaldson | |
| 2003/0131397 | A1 | 7/2003 | Sloan | |
| 2003/0196239 | A1 | 10/2003 | Zic et al. | |
| 2003/0208829 | A1 | 11/2003 | Ragot et al. | |
| 2003/0230121 | A1 | 12/2003 | Yokoyama | |
| 2003/0233062 | A1 | 12/2003 | McCormick et al. | |
| 2004/0016041 | A1 | 1/2004 | Uno et al. | |
| 2004/0016043 | A1 | 1/2004 | Uno et al. | |
| 2004/0033743 | A1 | 2/2004 | Worley et al. | |
| 2004/0078865 | A1 | 4/2004 | Culhane | |
| 2004/0107479 | A1 | 6/2004 | Dicker et al. | |
| 2004/0111781 | A1 | 6/2004 | Miyake et al. | |
| 2004/0111782 | A1 | 6/2004 | Lenormand et al. | |
| 2004/0133959 | A1 | 7/2004 | Horii et al. | |
| 2004/0192133 | A1 | 9/2004 | Kim et al. | |
| 2004/0260226 | A1 | 12/2004 | Gilmour | |
| 2005/0005340 | A1 | 1/2005 | Roux et al. | |
| 2005/0038367 | A1 | 2/2005 | McCormick et al. | |
| 2005/0081277 | A1 | 4/2005 | Matechen et al. | |
| 2005/0086721 | A1 | 4/2005 | Lambertz | |
| 2005/0114978 | A1 | 6/2005 | Benini | |
| 2005/0155137 | A1 | 7/2005 | Berger | |
| 2005/0187071 | A1 | 8/2005 | Yamashita et al. | |
| 2005/0193461 | A1 | 9/2005 | Caillibotte et al. | |
| 2005/0204449 | A1 | 9/2005 | Baron et al. | |
| 2005/0223753 | A1 | 10/2005 | Nordstrom | |
| 2006/0010559 | A1 | 1/2006 | Hamlet | |
| 2006/0021112 | A1 | 2/2006 | Roser et al. | |
| 2006/0026732 | A1 | 2/2006 | Nordt et al. | |
| 2006/0026733 | A1 | 2/2006 | Nordt et al. | |
| 2006/0026736 | A1 | 2/2006 | Nordt et al. | |
| 2006/0026740 | A1 | 2/2006 | Vargas et al. | |
| 2006/0048266 | A1 | 3/2006 | Kim | |
| 2006/0070164 | A1 | 4/2006 | Nordt et al. | |
| 2006/0070165 | A1 | 4/2006 | Nordt et al. | |
| 2006/0085894 | A1 | 4/2006 | Yakopson et al. | |
| 2006/0107436 | A1 | 5/2006 | Donaldson | |
| 2006/0130215 | A1 | 6/2006 | Torry | |
| 2006/0143801 | A1 | 7/2006 | Lambertz | |
| 2006/0169004 | A1 | 8/2006 | Belluye et al. | |
| 2006/0211968 | A1 | 9/2006 | Gordon et al. | |
| 2006/0217649 | A1 | 9/2006 | Rabe | |
| 2006/0247566 | A1 | 11/2006 | Gobet et al. | |
| 2007/0022510 | A1 | 2/2007 | Chapuis et al. | |
| 2007/0032359 | A1 | 2/2007 | Toronto | |
| 2007/0033696 | A1 | 2/2007 | Sellier | |
| 2007/0049856 | A1 | 3/2007 | Arensdorf | |
| 2007/0050879 | A1 | 3/2007 | Etzold et al. | |
| 2007/0074328 | A1 | 4/2007 | Melhart et al. | |
| 2007/0271668 | A1 | 11/2007 | Pape | |
| 2007/0283483 | A1 | 12/2007 | Jacober | |
| 2008/0022431 | A1 | 1/2008 | Gallo et al. | |
| 2008/0066211 | A1 | 3/2008 | Laugt et al. | |
| 2008/0120757 | A1 | 5/2008 | Nakazawa | |
| 2008/0134409 | A1 | 6/2008 | Karasina | |
| 2008/0141430 | A1 | 6/2008 | Rance et al. | |
| 2008/0141431 | A1 | 6/2008 | Rance et al. | |
| 2008/0155731 | A1 | 7/2008 | Kasahara | |
| 2008/0178365 | A1 | 7/2008 | Furgerson et al. | |
| 2008/0189824 | A1 | 8/2008 | Rock et al. | |
| 2008/0249454 | A1 | 10/2008 | Mills | |
| 2008/0255490 | A1 | 10/2008 | Daley | |
| 2008/0256691 | A1 | 10/2008 | White et al. | |
| 2008/0269655 | A1 | 10/2008 | Shoukry | |
| 2008/0295216 | A1 | 12/2008 | Nordstrom et al. | |
| 2008/0313793 | A1 | 12/2008 | Skottheim et al. | |
| 2009/0000339 | A1 | 1/2009 | Dahlgren | |
| 2009/0013450 | A1 | 1/2009 | Lambertz | |
| 2009/0018482 | A1 | 1/2009 | Lambertz | |
| 2009/0025115 | A1 | 1/2009 | Duffy et al. | |
| 2009/0044313 | A1 | 2/2009 | Anastsopoulos et al. | |
| 2009/0095023 | A1 | 4/2009 | Dong et al. | |
| 2009/0095026 | A1 | 4/2009 | Araki et al. | |
| 2009/0100715 | A1 | 4/2009 | Broadley | |
| 2009/0105704 | A1 | 4/2009 | Gordon, Jr. | |
| 2009/0126081 | A1 | 5/2009 | Lambertz | |
| 2009/0133181 | A1 | 5/2009 | Nordstrom et al. | |
| 2009/0151051 | A1 | 6/2009 | Chen | |
| 2009/0158504 | A1 | 6/2009 | Sparrow et al. | |
| 2009/0165190 | A1 | 7/2009 | Araki et al. | |
| 2009/0171259 | A1 | 7/2009 | Soerensen et al. | |
| 2009/0172858 | A1 | 7/2009 | Oya et al. | |
| 2009/0223254 | A1 | 9/2009 | Ishida | |
| 2009/0265828 | A1 | 10/2009 | Semba et al. | |
| 2009/0265858 | A1 | 10/2009 | White | |
| 2009/0276939 | A1 | 11/2009 | Sho et al. | |
| 2009/0282607 | A1 | 11/2009 | Kaneda | |
| 2009/0288451 | A1 | 11/2009 | Yokoyama | |
| 2010/0010568 | A1 | 1/2010 | Brown | |
| 2010/0050313 | A1 | 3/2010 | Shackelford, Jr. | |
| 2010/0113998 | A1 | 5/2010 | Mizumoto | |
| 2010/0229278 | A1 | 9/2010 | Bates | |
| 2011/0271423 | A1 | 11/2011 | Wright et al. | |
| 2011/0302686 | A1 | 12/2011 | Chapuis | |
| 2012/0174282 | A1 | 7/2012 | Newton et al. | |
| 2013/0212767 | A1 | 8/2013 | Nordstom et al. | |
| 2013/0232659 | A1 | 9/2013 | Levian | |
| 2014/0196190 | A1 | 7/2014 | Brown | |
| 2018/0111016 | A1 | 4/2018 | Brockway, Jr. et al. | |
| 2019/0216149 | A1 | 7/2019 | Diaz | |
| 2019/0343194 | A1 * | 11/2019 | Carr ..... | B32B 5/024 |

FOREIGN PATENT DOCUMENTS

| | | | |
|---|---|---|---|
| DE | 202006001381 | U1 | 6/2006 |
| EP | 1810649 | A1 | 7/2007 |
| EP | 1897983 | A1 | 3/2008 |
| FR | 2631523 | A1 | 11/1989 |
| JP | 361239002 | A | 10/1986 |
| JP | H03101929 | | 10/1991 |
| JP | H05010405 | | 2/1993 |
| JP | H11124702 | A | 5/1999 |

(56) References Cited

FOREIGN PATENT DOCUMENTS

| | | | |
|---|---|---|---|
| JP | 3119255 | B2 | 12/2000 |
| JP | 2002220708 | A | 8/2002 |
| JP | 3090737 | U | 12/2002 |
| JP | 2003038207 | A | 2/2003 |
| JP | 2003532800 | A | 11/2003 |
| JP | 2004044070 | A | 2/2004 |
| JP | 2004263362 | A | 9/2004 |
| JP | 2005264394 | A | 9/2005 |
| JP | 2005299070 | A | 10/2005 |
| JP | 2006097213 | A | 4/2006 |
| JP | 2006225833 | A | 8/2006 |
| JP | 2006291399 | A | 10/2006 |
| JP | 5161302 | B2 | 3/2013 |
| JP | 2013067941 | A | 4/2013 |
| JP | 2013100633 | A | 5/2013 |
| WO | 2004014495 | A1 | 2/2004 |
| WO | 2005102083 | A1 | 11/2005 |
| WO | 2006032096 | A1 | 3/2006 |
| WO | 2017144938 | A1 | 8/2017 |

OTHER PUBLICATIONS

"Does Neoprene Stretch," by Zoe Van-de-Velde, updated Apr. 24, 2017 and printed from http://sciencing.com/neoprene-stretch-7505575.html.

Definition of "Matrix," Merriam Webster's Collegiate Dictionary, Tenth Edition (1997), p. 717.

* cited by examiner

Fig. 7A
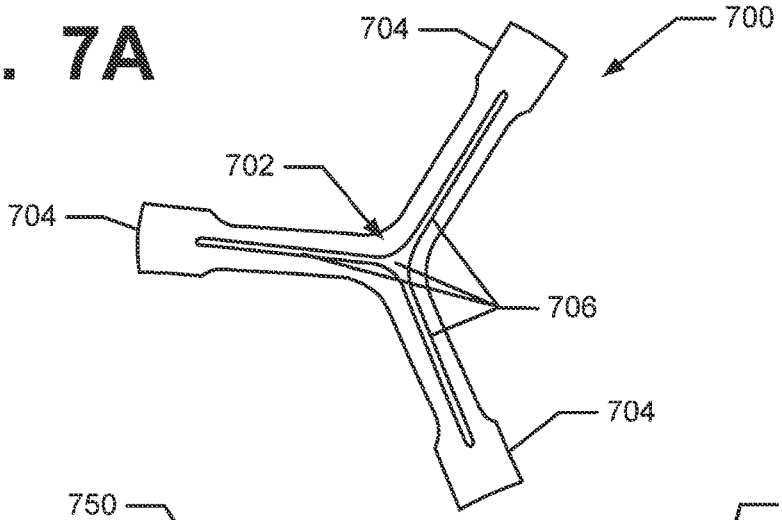
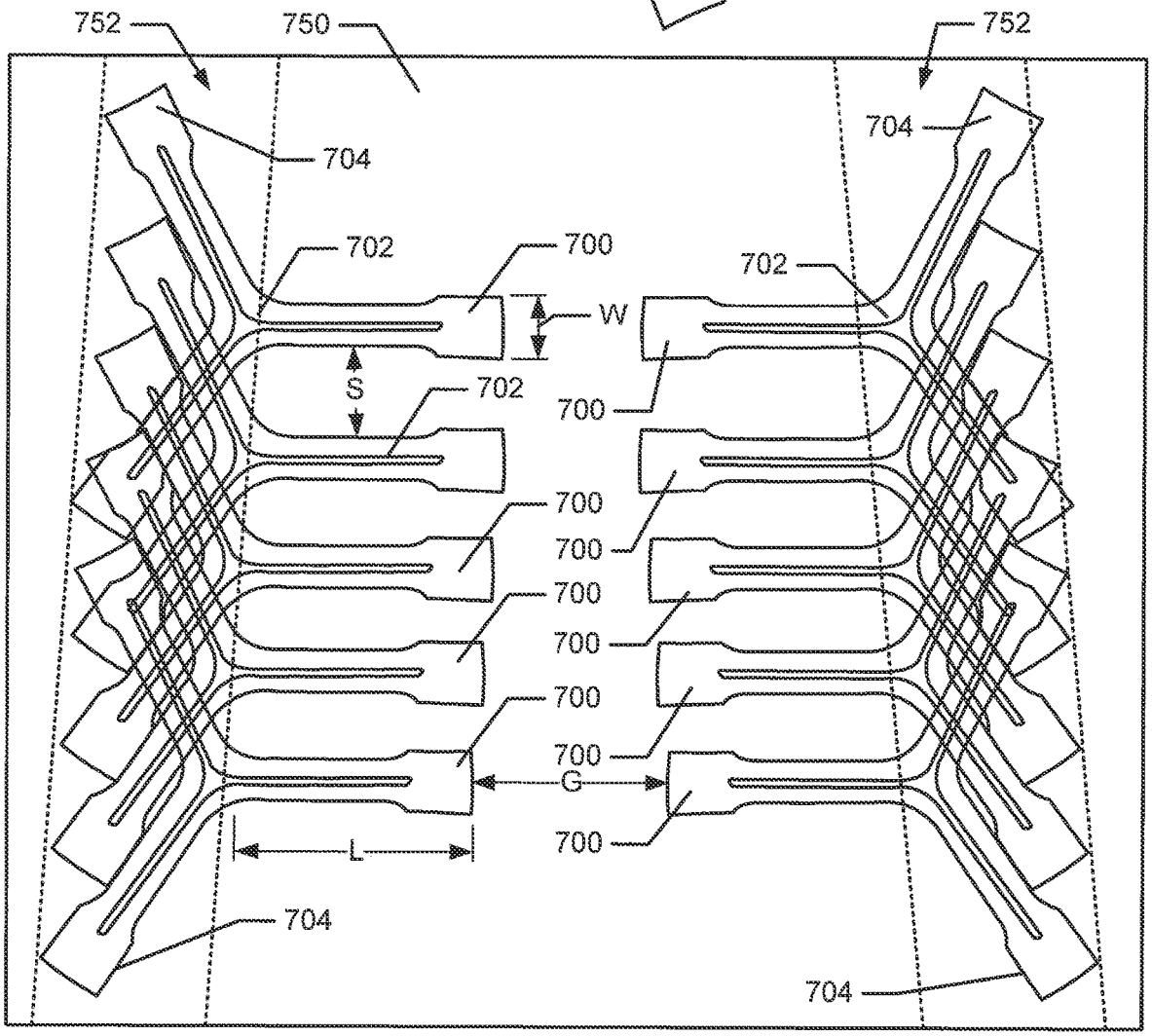
Fig. 7B

ARTICLES OF APPAREL PROVIDING ENHANCED BODY POSITION FEEDBACK

RELATED APPLICATION DATA

This application is: (a) a continuation of co-pending U.S. patent application Ser. No. 15/728,788 filed Oct. 10, 2017, which application is (b) a divisional of U.S. patent application Ser. No. 14/196,496 filed Mar. 4, 2014 (now U.S. Pat. No. 9,814,273 issued Nov. 14, 2017), which application is (c) a continuation of U.S. patent application Ser. No. 13/679,641 filed Nov. 16, 2012 (now U.S. Pat. No. 8,677,512 issued Mar. 25, 2014), which application is (d) a divisional of U.S. patent application Ser. No. 12/277,914 filed Nov. 25, 2008 (now U.S. Pat. No. 8,336,118 issued Dec. 25, 2012), which application is (e) a continuation-in-part of U.S. patent application Ser. No. 11/756,291 filed May 31, 2007 (now U.S. Pat. No. 7,934,267 issued May 3, 2011). Each of these parent applications is entirely incorporated herein by reference.

FIELD OF THE INVENTION

The present invention relates to articles of apparel that provide enhanced body position sensory information to the wearer. Structures for providing the enhanced body position information to the wearer may be separate elements engaged with an article of apparel or integrally formed as part of the fabric of the apparel structure.

BACKGROUND

Many athletic activities require the participants to perform the same or similar activities a repeated number of times, both in practice and during competitive events. For example, golfers repeatedly swing golf clubs over the course of a round or a practice session; baseball, softball, or cricket players repeatedly swing a bat or throw a ball over the course of a game or practice; yoga enthusiasts, gymnasts, and dancers repeatedly perform similar steps, maneuvers, or routines; basketball players repeatedly shoot free throws and other types of shots; football players repeatedly run, throw, kick, block, rush, run, etc.; sailors, kayakers, canoers, crew team members, or other "boat" based athletes repeatedly perform rowing or other motions; runners have repeated and cyclic arm and leg motions; etc.

Correct body positioning and/or motion during various portions of athletic performances can help the athlete in a variety of ways. For example, proper body positioning and/or posture during an activity can help the athlete: apply or exert a force more efficiently and/or in a better direction with respect to another object; avoid injury due to awkward positioning or landing; prevent muscle soreness; perform a more aesthetically pleasing or sound routine; etc. Trainers and coaches spend a great deal of time helping athletes develop proper body positioning and working on their "form," in order to enhance the athletic performance and to build a repeatable and reliable action.

Working under the watchful eye of a coach or trainer can greatly improve an athlete's form or body positioning, which can result in improved athletic performances. For most people, however, a coach or trainer is not always available, and there often is no great way for the athlete, on his or her own, to check their body positioning and form because many areas of the athlete's body are not visible to him or her during the practice or performance. Human beings cannot readily "feel" the locations of various parts of their body in normal body posture or positions and/or during typical motions (e.g., a human typically cannot "feel" the position of his or her lower back or a position of the foot arch during stances or certain motions). Therefore, an athlete can easily adopt poor posture or body positioning and/or form other habits over time in a manner that deleteriously affects his/her performance.

SUMMARY OF THE INVENTION

The following presents a general summary of aspects of the present invention in order to provide a basic understanding of the invention and various example features of it. This summary is not intended to limit the scope of the invention in any way, but it simply provides a general overview and context for the more detailed description that follows.

Aspects of this invention relate to body position feedback systems and garment structures having body position feedback systems incorporated therein. The body position feedback systems may include one or more layers of material that have a compressive force application capability (or resistance to stretching) that is greater than the compressive force application capability (or resistance to stretching) of a material element making up a majority of the garment structure. The body position feedback system does not function to "brace" or alter the position of the wearer's body. Rather, by applying compressive forces at spaced apart locations on the body, the wearer has a heightened tactile feel of the body position feedback system (e.g., amplified sensory information), and therefore, greater awareness of the body's position. In other words, the closely spaced and juxtaposed compressed and uncompressed areas (but not too small or closely spaced) enhances the wearer's "feel" and awareness of the garment on the body and thus the body's position.

In some example structures according to this invention, body position feedback systems for engagement with articles of apparel may include: (a) a first material layer having a first compressive force application capability, wherein the first material layer includes a base area and plural independent legs extending from the base area, and wherein a continuous first opening extends along the plural independent legs and through the base area; and (b) a second material layer engaged with the first material layer and at least partially covering the first opening (optionally, completely covering the first opening), wherein the second material layer has a second compressive force application capability that is lower than the first compressive force application capability. Optionally, if desired, the feedback system further may include a third material layer, wherein a first surface of the third material layer is engaged with at least one of the first material layer or the second material layer, and wherein the second material layer is sandwiched between the first material layer and the third material layer. A second surface of the third material layer (located opposite the first surface) may include a material for engaging the third material layer with a garment structure.

Other example body position feedback systems in accordance with this invention may take the form of different materials, different stitches, different knitting constructions, or different weaving constructions that are integrally incorporated into the material making up the garment structure, e.g., during knitting, weaving, or sewing processes. As some more specific examples, the different region(s) or material layer(s) providing the higher compressive force application capability may be integrally provided, for example, by incorporating different materials (materials having different elasticities) into the garment structure at selected locations; by using different stitching, knitting, or weaving patterns; by providing different material thicknesses and/or texturing; etc.

The body position feedback systems may be incorporated into a garment structure at a location so as to enhance the wearer's awareness of the positioning of that portion of the body. As some more specific examples, the material layer(s) including the higher compressive force application capability (or higher resistance to stretch) may be located around the abdominal region, around the lower back region, around or across the upper back region, in the shoulder region, in the pectoral region, near the knee joint, near the elbow joint, around the ankle, etc.

Additional aspects of this invention relate to methods of making body position feedback systems and/or articles of apparel that include one or more body position feedback systems. For example, a body position feedback system including one or more layers of material may be constructed and then attached to a garment structure, e.g., by stitching or sewing, by adhesives or cements, by mechanical connectors, etc. As another example, as described above, the body position feedback system may be integrally incorporated into the garment structure, e.g., during sewing, stitching, weaving, or knitting of the garment structure.

BRIEF DESCRIPTION OF THE DRAWINGS

The present invention is illustrated by way of example and not limited in the accompanying figures, in which like reference numerals indicate the same or similar elements throughout, and in which.

The reader is advised that the various parts shown in these drawings are not necessarily drawn to scale.

DETAILED DESCRIPTION

The following description and the accompanying figures disclose features of body position feedback systems, articles of apparel, and methods of making such systems and articles in accordance with examples of the present invention.

I. GENERAL DESCRIPTION OF BODY POSITION FEEDBACK SYSTEMS AND METHODS IN ACCORDANCE WITH THIS INVENTION

As described above, humans cannot readily "feel" the locations of various parts of their body in normal body posture or positions and/or during typical motions or activities. For example, a human's back, and particularly the lower back, has a relatively sparse "touch sensing" neural population. The human body core, its positioning, and its motion (including the back), however, are very important for many athletic activities. For example, the body core is a center point of rotation and power generation in a golf swing. Moreover, being able to repeatedly place the body in the proper posture and correctly positioning the body at the beginning of and over the course of the swing are critical to developing a consistent and repeatable swing (and thereby improving one's golf game).

Figure 1:
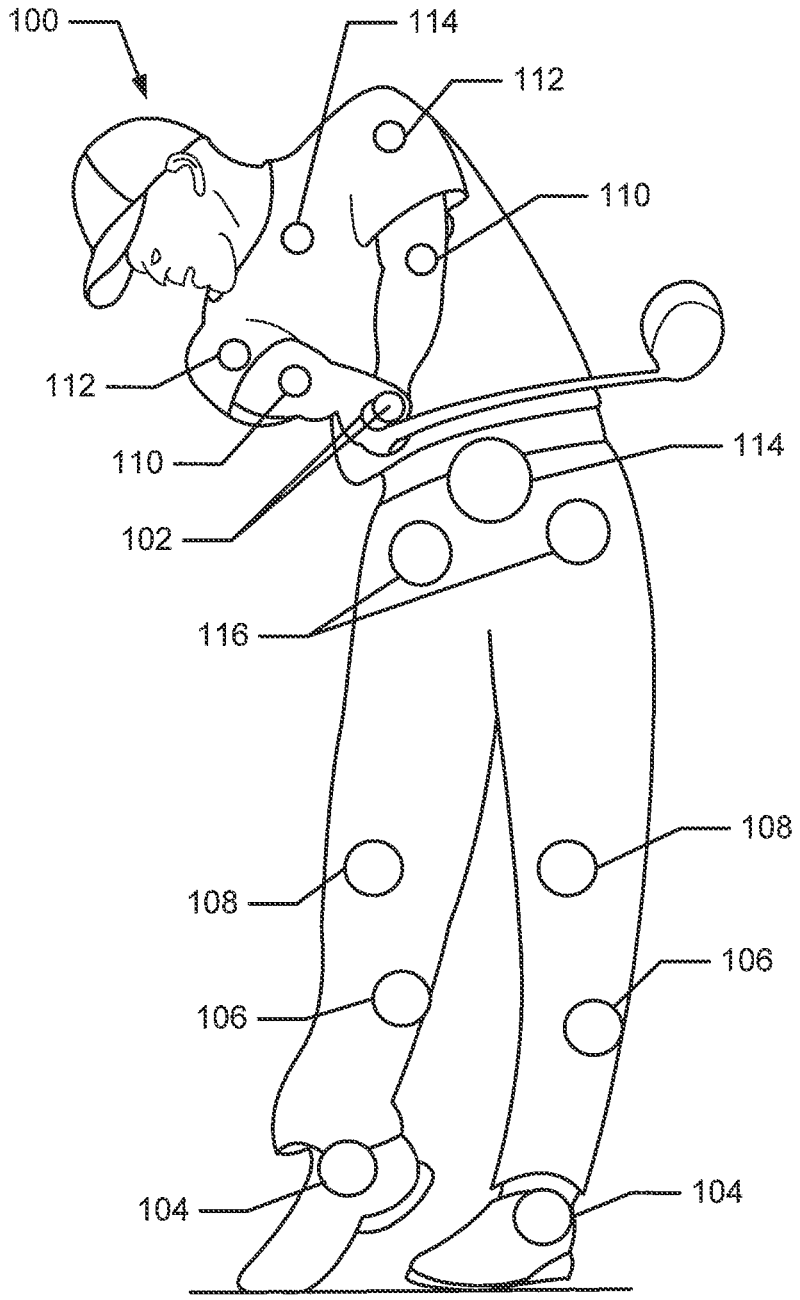
FIG. 1 illustrates an athlete making a golf swing and various zones of the body for which positioning and/or motion can be important during this activity.

FIG. 1 illustrates a golfer 100 in mid-swing. Body positioning at the beginning of the swing (e.g., posture at the address position) and over the course of a swing can be very important to the results achieved. FIG. 1 illustrates various zones or areas of the human body, the positions of which during at least some time during the swing can be important to the results achieved. For a golf swing, these important zones include: the hands 102; the feet and ankles 104; the calves 106; the knees 108; the arms 110; the shoulders 112; the sacrum (lower back) and core 114; and the hips 116. Assistance in properly positioning one or more of these zones at various times during the golf swing (e.g., posture at address, other times over the course of a swing, etc.) can greatly assist in helping athletes repeatedly place the body in the proper posture and correctly positioning the body over the course of the swing. While illustrated in conjunction with a golf swing, aspects of this invention may be extended to a wide variety of other athletic activities, e.g., as described above.

Aspects of this invention relate to garments that help make wearers more aware of the positioning of various selected parts of the body, e.g., due to enhanced stimulation of nerves, joint mechanorecptors, and/or deep tissue receptors at the selected parts of the body. Garments can be designed to closely fit (and optionally at least partially wrap around) one or more of the various areas or zones described above in conjunction with FIG. 1. Additionally, such garments can include body position feedback enhancing structures or regions, e.g., that apply a compressive force along or around various parts of the body (and resist tensile elongation), to enhance somatosensory feedback relating to the position of various parts of the body adjacent the enhanced feedback areas of the garment and enhance user "awareness" of the position of these various parts of the body. Such improved "awareness" can help athletes better position themselves, develop "muscle memory," and maintain better positioning over time.

Advantageously, in accordance with at least some examples of this invention, the body position feedback structures or regions will include juxtaposed regions in which compressive forces are applied and regions in which compressive forces are not applied. The differential in the applied compressive forces at the adjacent regions tends to enhance the wearer's feel and awareness of the body position at these locations. Various structures and ways of creating this differential in applied compressive forces at adjacent locations will be described below. The garments need not support or affect the movement or positioning of the area of the body (e.g., need not act as a brace), but rather, these garments may simply increase sensory awareness of the positioning of that region of the body.

As mentioned above, aspects of this invention relate to body position feedback systems that may be used with or integrated into articles of apparel, such as upper and/or lower torso clothing (e.g., shirts, blouses, tank tops, leotards, leggings, form fitting garments, pants, shorts, skirts, undergarments, etc.); socks or other garments that at least partially contain a human foot or leg; gloves or other garments that at least partially cover or contain at least a portion of a human hand or arm; etc. Special garments may be provided to at least partially contain or fit over or against the desired part of the body, such as a sleeve or wrap for insertion of a leg or arm, garments or wraps to contain or cover any of the areas illustrated in FIG. 1, etc.

A. Feedback Systems According to Examples of the Invention

Body position feedback systems and garment structures having separately engaged body position feedback systems will be described in more detail. In some example structures according to this invention, body position feedback systems for engagement with articles of apparel may include: (a) a first material layer having a first compressive force application capability, wherein the first material layer is made from a textile or polymer material, wherein the first material layer includes a base area and plural independent legs extending from the base area, and wherein a continuous first opening extends along the plural independent legs and through the base area; and (b) a second material layer engaged with the first material layer and at least partially covering the first opening (optionally, completely covering the first opening), wherein the second material layer is made from a fabric or polymer material, and wherein the second material layer has a second compressive force application capability that is lower than the first compressive force application capability. Optionally, if desired, the feedback system further may include a third material layer, wherein a first surface of the third material layer is engaged with at least one of the first material layer or the second material layer, and wherein the second material layer is sandwiched between the first material layer and the third material layer. A second surface of the third material layer (located opposite the first surface) may include a material for engaging the third material layer with a garment structure. The third material layer (as well as the second material layer) also may be shaped consistent with the first material layer, optionally to provide a tackle twill type appearance.

The legs of the first material layer (and optionally also the second and/or third material layers) may extend away from the base area in substantially parallel directions or in different directions. In some example structures in accordance with this invention, the base area will include an elongated longitudinal direction and the plural independent legs will include three to six legs that extend away from this base area in a direction away from the elongated longitudinal direction. In other example structures in accordance with this invention, the plural independent legs of the various material layers will include three (or more) legs that extend away from the base area such that the free ends of the plural independent legs are arranged as points of a triangle (e.g., an equilateral triangle). Other arrangements of the base area and the various legs are possible without departing from this invention.

In other body position feedback systems in accordance with this invention, the system may constitute one or more layers of material wherein at least one material layer has a first compressive force application capability that is greater than a compressive force application capability of the fabric element making up a largest proportion of the garment structure to which the system is to be attached. The first material layer may be made from a textile or polymer material, and it may take on a variety of forms. For example, the first material layer may constitute a matrix structure, two or more intersecting elongated strips of material (continuous or discontinuous strips), or the like. Other structures and arrangements of the material layer are possible without departing from this invention.

Optionally, if desired, at least some portions of body position feedback systems in accordance with examples of this invention may take the form of different materials, stitches, knitting, or weaving structures that are integrally incorporated into the material making up the garment structure, e.g., during knitting, weaving, or sewing processes. As some more specific examples, the different region(s) or material layer(s) providing the higher compressive force application capability may be integrally provided, for example, by incorporating different materials (materials having different elasticities) into the garment structure at selected locations; by using different stitching, knitting, or weaving patterns; by providing different material thicknesses and/or texturing; etc.

B. Article of Apparel Structures According to Examples of the Invention

Additional aspects of this invention relate to articles of apparel that include one or more body position feedback systems in accordance with examples of this invention. Such articles of apparel may include, for example: (a) a garment structure for covering at least a portion of a torso of a human (e.g., an abdominal area, a shoulder area, an upper back area, a pectoral area, etc.), wherein the garment structure includes one or more fabric elements, and wherein the garment structure is structured and arranged so as to provide a close fit to at least some of the torso (e.g., the abdominal area, the shoulder area, the upper back area, the pectoral area, etc.); and (b) at least a first body position feedback system engaged with the garment structure. The first body position feedback system may include: (i) a first material layer having a first compressive force application capability that is greater than a compressive force application capability of the fabric element making up a largest proportion of the garment structure, wherein the first material layer is made from a textile or polymer material, wherein the first material layer includes a base area and plural independent legs extending from the base area, and wherein a continuous first opening extends along the plural independent legs and through the base area; and (ii) a second material layer engaged with the first material layer and at least partially covering the first opening, wherein the second material layer is made from a fabric or polymer material, and wherein the second material layer has a second compressive force application capability that is lower than the first compressive force application capability. An individual garment structure may include more than one body position feedback system, e.g., arranged in a spaced apart and/or overlapping manner.

The different region(s) or material layer(s) providing the higher compressive force application capability also may be integrally provided as part of the garment structures in any desired manners, for example, in the various ways described above (e.g., by incorporating different materials (materials having different elasticities) into the garment structure at selected locations; by using different stitching, knitting, or weaving patterns; by providing different material thicknesses and/or texturing; etc.). When multiple regions of higher compressive force application capability are provided in a single garment structure, the different regions may be constructed in the same manner or in different manners without departing from this invention.

Various examples of the arrangements and structures of the material layer(s) providing the high compressive force properties are provided in the detailed description of the figures below.

C. Example Methods According to the Invention

Additional aspects of this invention relate to methods of making body position feedback systems and/or articles of apparel that include one or more body position feedback systems. For example, a body position feedback system including one or more layers of material may be constructed and then attached to a garment structure, e.g., by stitching or sewing, by adhesives or cements, by mechanical connectors, etc. As another example, as described above, the body position feedback system may be integrally incorporated into the garment structure, e.g., during sewing, stitching, weaving, or knitting of the garment structure. Other method steps used in conventional garment manufacture may be incorporated into the methods without departing from this invention.

Given the general description of various examples and aspects of the invention provided above, more detailed descriptions of various specific examples of body position feedback systems, garment structures, and methods according to the invention are provided below.

II. DETAILED DESCRIPTION OF EXAMPLE BODY POSITION FEEDBACK SYSTEMS, ARTICLES OF APPAREL, AND METHODS ACCORDING TO THE INVENTION

The following discussion and accompanying figures describe various example body position feedback systems, articles of apparel, and methods of making these items in accordance with the present invention. When the same reference number appears in more than one drawing, that reference number is used consistently in this specification and the drawings to refer to the same or similar parts throughout.

Figure 2B:
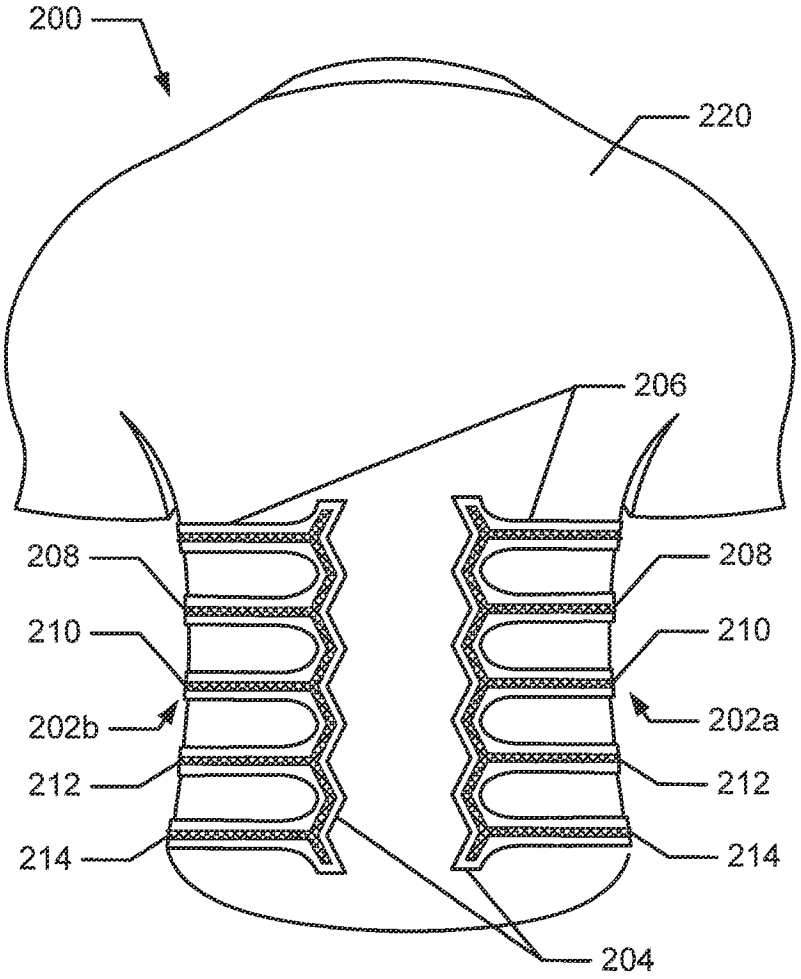
FIGS. 2A and 2B illustrate an example article of apparel with an abdominal core position feedback system incorporated therein.
Figure 2A:
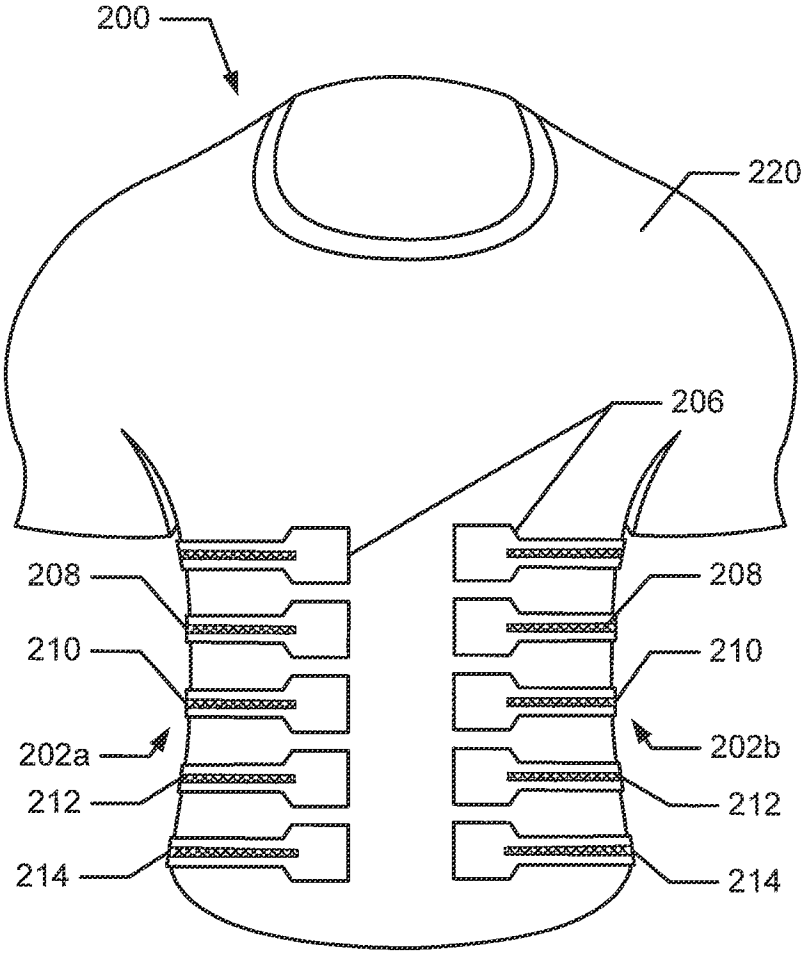

FIGS. 2A and 2B illustrate the front and back, respectively, of a garment structure 200 including two example body position feedback systems 202*a* and 202*b* in accordance with this invention. In this example structure 200, the body position feedback systems 202*a* and 202*b* are designed and located in the garment structure 200 to provide the wearer with information regarding the positioning of the abdominal core, sides, lower back and/or sacrum areas of the body.

The garment structure 200 may be made from one or more fabric elements, e.g., in conventional manners, from conventional materials, and/or of conventional constructions (e.g., using any desired number of individual fabric elements or pieces 220 engaged together via sewing or in another desired manner), without departing from this invention. In some examples, the garment structure 200 may be made at least in part from an elastomeric material, such as a spandex material, or other material that provides a tight, close fit over the body or at least over a portion of the body where the body position feedback systems 202*a* and 202*b* are to be located (in the abdominal core, sides, lower back and/or sacrum areas of the body core, in this illustrated example structure 200). As one more specific example, the base fabric 220 of at least part of the garment structure 200 may be a DRI-FIT® fabric material of the type commercially available from NIKE, Inc. of Beaverton, Oreg. If desired, all or some portions of the base fabric 220 may be made from a mesh material or other breathable material to provide a cool and comfortable fit.

The body position feedback systems 202*a* and 202*b* in this example structure 200 include various vertically staggered legs 206, 208, 210, 212, and 214 that extend from a base area 204 located at the central back area. The legs 206, 208, 210, 212, and 214 extend from the central back area, around the garment sides, and to the central front area of the garment structure 200. The body position feedback systems 202*a* and 202*b*, including at least some of the legs 206, 208, 210, 212, and 214, will have a higher "modulus of elasticity" (e.g., resistance to stretching, compressive force applying capability, etc.) as compared to the modulus of elasticity (e.g., resistance to stretching, compressive force applying capability, etc.) associated with a material 220 or structure making up the largest proportion of the garment structure 200 and/or the material 220 or structures that the feedback systems 202*a* or 202*b* cover.

While the body position feedback systems 202*a* and 202*b* can take on a wide variety of sizes and shapes without departing from this invention, as illustrated in the example structure 200 of FIGS. 2A and 2B, at least some portions of the body position feedback systems 202*a* and 202*b* will have a continuous structure in a direction so as to extend around (or wrap around) a sufficient part of the body for which enhanced position sensing is desired. For example, FIGS. 2A and 2B illustrate that each of legs 206, 208, 210, 212, and 214 extends from the central back area, around the garment side, and to the central front area of the garment structure 200. The legs 206, 208, 210, 212, and/or 214 may be arranged to provide feedback associated with specific targeted body parts, such as one or more vertebrae or other areas of the abdominal, lumbar, or core area of the body. During the desired activity (e.g., when at the golf ball address position, during a golf swing, when setting up to pitch or throw a ball, etc.), the abdomen and/or lower back (or other portion of the body) will stretch or move against the relatively high stretch resistance or compressive force associated with the body position feedback systems 202*a* and 202*b*. Because of its higher resistance to stretching, the legs 206, 208, 210, 212, and 214 of the body position feedback systems 202*a* and 202*b* will cause some level of compression or resistance to the stretching or movement (without substantially impeding, altering, or affecting the desired movement), which helps better stimulate the deep tissue located nerves or sensory receptors in the wearer's abdomen and lower back. This stimulation provides sensory feedback to the garment wearer and better makes the wearer aware of the positioning of the targeted part of the body.

Figure 3B:
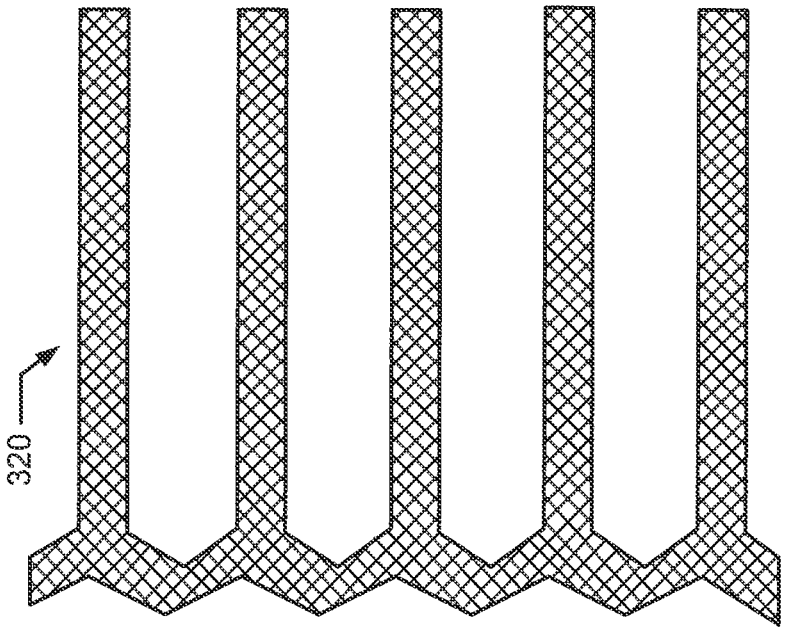
FIGS. 3A through 3C illustrate more detailed views of the abdominal core position feedback system illustrated in FIGS. 2A and 2B.
Figure 3A:
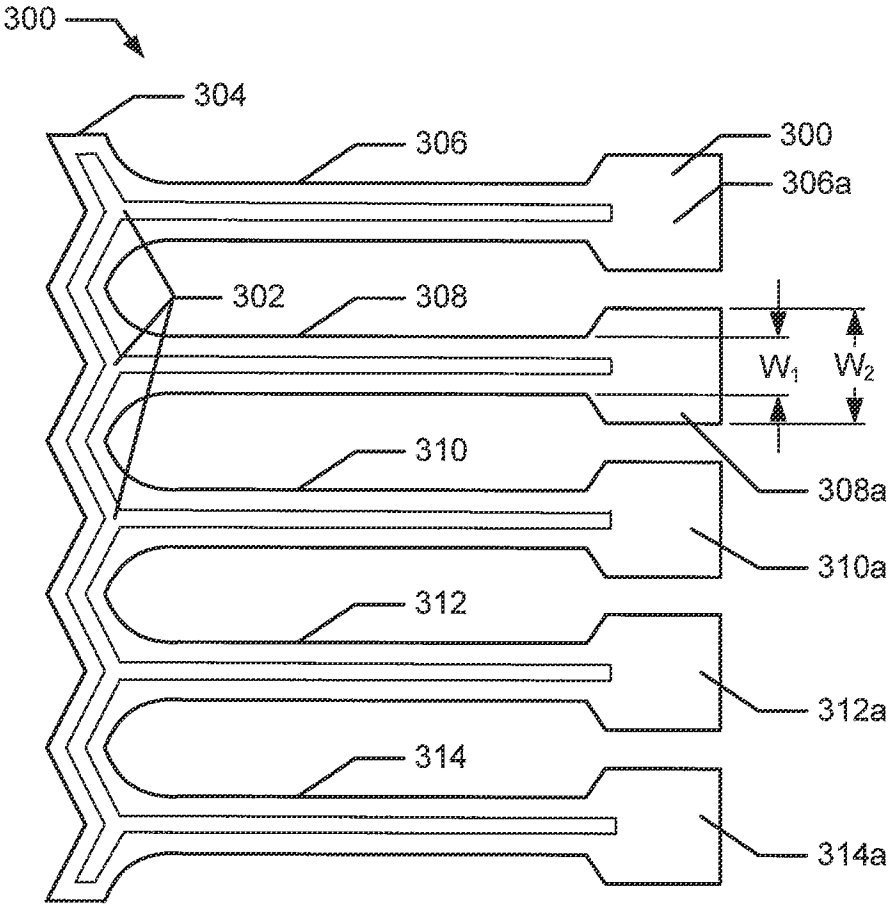
Figure 3C:
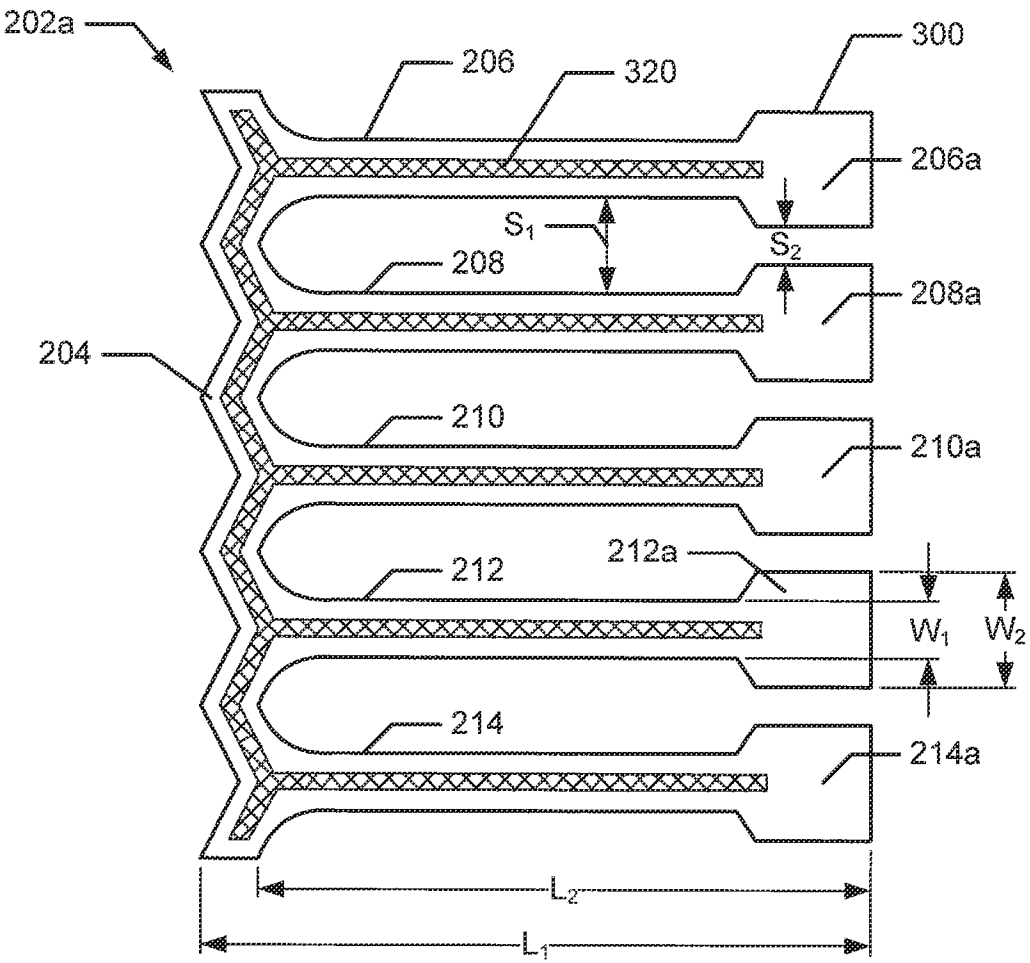

FIGS. 3A through 3C illustrate more details of a body position feedback system 202*a* according to this example of the invention. FIG. 3A shows a first material layer 300 that may provide all or a majority of the high "modulus of elasticity" (e.g., resistance to stretching, compressive force applying capability, etc.) in the system 202*a*. As shown in FIG. 3A, this first material layer 300 includes a common base area 304 and five legs 306, 308, 310, 312, and 314 extending from the common base area 304 in a parallel (or substantially parallel, e.g., ±10°) direction. The free ends 306*a*, 308*a*, 310*a*, 312*a*, and 314*a* of the legs 306, 308, 310, 312, and 314 have somewhat expanded width dimensions $W_2$ as compared to the width dimensions $W_1$ of the majority of their longitudinal lengths. While shown as a common size in this example structure 300, the various legs, their free ends, and the like, may take on a wide variety of sizes, shapes, positions, and the like without departing from this invention, and the various sizes, shapes, and relative positions may vary within a given material layer structure 300.

The first material layer 300 includes one or more openings 302 defined therein. The openings 302 may take on a wide variety of configurations without departing from this invention, such as continuous, discontinuous, in a repeating pattern, in an irregular pattern, etc. In this illustrated example, the first material layer 300 has a single, continuous opening 302 defined therein, which generally extends throughout the base area 304 and along a majority of the length of the legs 306, 308, 310, 312, and 314. While shown as stopping at the start of the expanded free ends 306*a*, 308*a*, 310*a*, 312*a*, and 314*a* in this example structure, the opening(s) 302, if any, may extend any desired amount of the base area 304 and/or the leg elements 306, 308, 310, 312, and 314 without departing from this invention. While not necessary in all body position feedback systems, the opening(s) 302 provide somewhat greater flexibility to the first material layer 300 (to help reduce or eliminate "bunching" when flexed), and they help reduce the heat retention of the garment structure at the areas around the first material layer 300.

Any desired type of material may be used for the first material layer 300 without departing from this invention. In this illustrated example, the material layer 300 may be a material having a higher modulus of elasticity (e.g., more resistant to tensile stretching forces and/or providing a higher compression force) as compared to that of the fabric elements making up other portions of the garment structure (e.g., compared to the stretch resistance or compressive force applying capability for the spandex, cotton, polyester, or other fabric elements 220 making up the garment structure 200). As some more specific examples, material layer 300 may be materials commonly used in tackle twill production, a canvas type material, a polyester type material, a thermoplastic polyurethane adhesive material, etc. In some structures, the material layer 300 will be made from or contain a suitable material so as to allow material layer 300 to be joined to another material later in the body position feedback system construction process (e.g., by lamination processes, through application of heat and/or pressure, by adhesives, etc.).

If desired, the opening(s) 302 in the first material layer 300 may be covered. FIG. 3B illustrates an example of a second material layer 320 that may be applied over the opening(s) 302 to provide a body position feedback system 202*a* (shown in FIG. 3C). If desired, as illustrated in FIGS. 3A and 3B, the second material layer 320 may have generally the same size and shape as the first material layer member 300, but, if desired, the second material layer 320 may be of somewhat different size (e.g., somewhat smaller) and/or somewhat different shape (e.g., with no expanded end portions, shorter, etc.).

The second material layer 320 may be made from any desired material without departing from this invention, including any type of material conventionally used in garment and apparel manufacture. In at least some examples of this invention, the second material layer 320 will be made from a flexible material, such as cotton, polyester, etc., and optionally from the same material included in at least one of the other fabric elements 220 of the garment structure 200. While in some example structures the second material layer 320 may be made from a material having a higher resistance to stretching or higher compressive force application capability than that of the fabric element making up the largest proportion of the garment structure 200 and/or a higher resistance to stretching or higher compressive force application capability than the first material layer 300, in this illustrated example structure the second material layer 320 will have the same or a lower resistance to stretching than the first material layer 300. As some more specific examples, the second material layer 320 may be made from a mesh material, such as high performance sweat management materials (e.g., thin, lightweight fabrics made from or containing polyester microfibers, polyester microfiber/cotton blends, polyester microfiber/cotton/spandex blends, polyester/spandex blends, and the like), such as "Sphere Dry" polyester knit materials and/or a Dri-FIT® polyester materials, e.g., as included in various commercial products available from NIKE, Inc., of Beaverton, Oreg. (this same material or similar materials also may be used as other fabric elements 220 in the overall garment structure 200).

As shown in FIG. 3C, the largest continuous dimensions of the high compressive force applying regions 202*a* (length dimension "$L_1$") corresponds to the location(s) of the legs 206, 208, 210, 212, and 214, extending across the central back area to the central front area. Each leg 206, 208, 210, 212, and 214 includes separate free end regions (206*a*, 208*a*, 210*a*, 212*a*, and 214*a*), and the legs 206, 208, 210, 212, and 214 are connected to one another in this example structure 202*a* by a common base region 204. Like the legs 206, 208, 210, 212, and 214, the common base region 204 may be made of a material having a higher stretch resistance (or compressive force application capability) than that of the fabric element making up the largest proportion of the garment structure 200 and/or that of the material(s) that it covers. This base region 204 may be located at the central back region of the garment structure 200, optionally off to one side of the very center spine area of the garment 200. While not necessary in all body position feedback system structures according to the invention, base region 204 holds legs 206, 208, 210, 212, and 214 together, which can assist in positioning the feedback system 202*a* on the garment 200 and manufacturing the overall garment 200.

As noted above, in this illustrated example structure 202*a*, at least one of the legs 206, 208, 210, 212, and/or 214 will have a sufficient overall length (dimension "$L_1$" from one free end 206*a*, 208*a*, 210*a*, 212*a*, and/or 214*a* of a leg 206, 208, 210, 212, and/or 214 to the opposite end of the base area 204—see FIG. 3C) so as to extend around the desired portion of the body (from the central back area, around the side, to the central front area, in this example). In this manner, the legs 206, 208, 210, 212, and/or 214 will apply a stretch or movement resisting force (or a compressive force) to that portion of the body. This overall length dimension "$L_1$" may vary, e.g., depending on the garment size and/or the portion of the body to be contained (e.g., at least 10 cm, at least 15 cm, at least 25 cm, at least 30 cm, or even more). Moreover, in at least some example structures 202*a*, this length dimension $L_1$ will be substantially greater than the overall width dimension "$W_1$" of the corresponding leg 206, 208, 210, 212, and/or 214 at its central area and/or substantially greater than the overall width dimension "$W_2$" of the free ends portions 206*a*, 208*a*, 210*a*, 212*a*, and/or 214*a* of the legs 206, 208, 210, 212, and/or 214. In at least some example structures according to this invention, the $L_1$:$W_1$ and/or $L_1$:$W_2$ ratio may be at least 4, and in some structures, it may be at least 7, at least 10, at least 12, or even more. Similarly, the actual leg length dimension $L_2$, absent the common base region 204, may be in a range from 0.5 $L_1$ to 0.99 $L_1$, or even within the ranges of 0.75 $L_1$ to 0.95 $L_1$ or 0.85 $L_1$ to 0.95 $L_1$.

FIG. 3C further illustrates that the higher compressive force applying legs 206, 208, 210, 212, and 214 are separated from one another. This separation provides several adjacent areas with differently applied compressive forces (e.g., areas with compressive forces applied thereto located adjacent to areas without compressive force applied thereto). This "differential" of applied forces (or differential in resistance to stretching) can further enhance the wearer's "feel" and awareness of the body position. Any desired distance or amount of separation may be used without departing from this invention. As some more specific examples, the separation distance along the majority of the length of the legs "$S_1$" (exclusive of the free end portions 206*a*, 208*a*, 210*a*, 212*a*, and/or 214*a*) may be within the range of 0.25 $W_1$ to 2 $W_1$, and in some structures, within the range of 0.5 $W_1$ to 1.5 $W_1$ or even 0.75 $W_1$ to 1.25 $W_1$. The free ends 206*a*, 208*a*, 210*a*, 212*a*, and/or 214*a* may maintain a separation distance "$S_2$", if desired. As some more specific examples, if desired, $S_2$ may be within the range of 0 to 1.5 $W_1$, and in some examples, between 0 to 1 $W_1$, or even 0 to 0.5 $W_1$.

As mentioned above, body position feedback systems in accordance with this invention may be separately attached to a garment structure (e.g., overlaying one or more fabric elements of a conventional article of apparel structure, etc.) or it may be integrally formed as part of the garment structure. Both of these types of body position feedback systems may take on a wide variety of different forms and/or constructions without departing from this invention. One example of a suitable body position feedback system (e.g., systems 202*a* and 202*b* of FIGS. 2A and 2B) and its construction and incorporation into an article of apparel structure is described in more detail below in conjunction with FIGS. 4A through 4F.

Figure 4A:
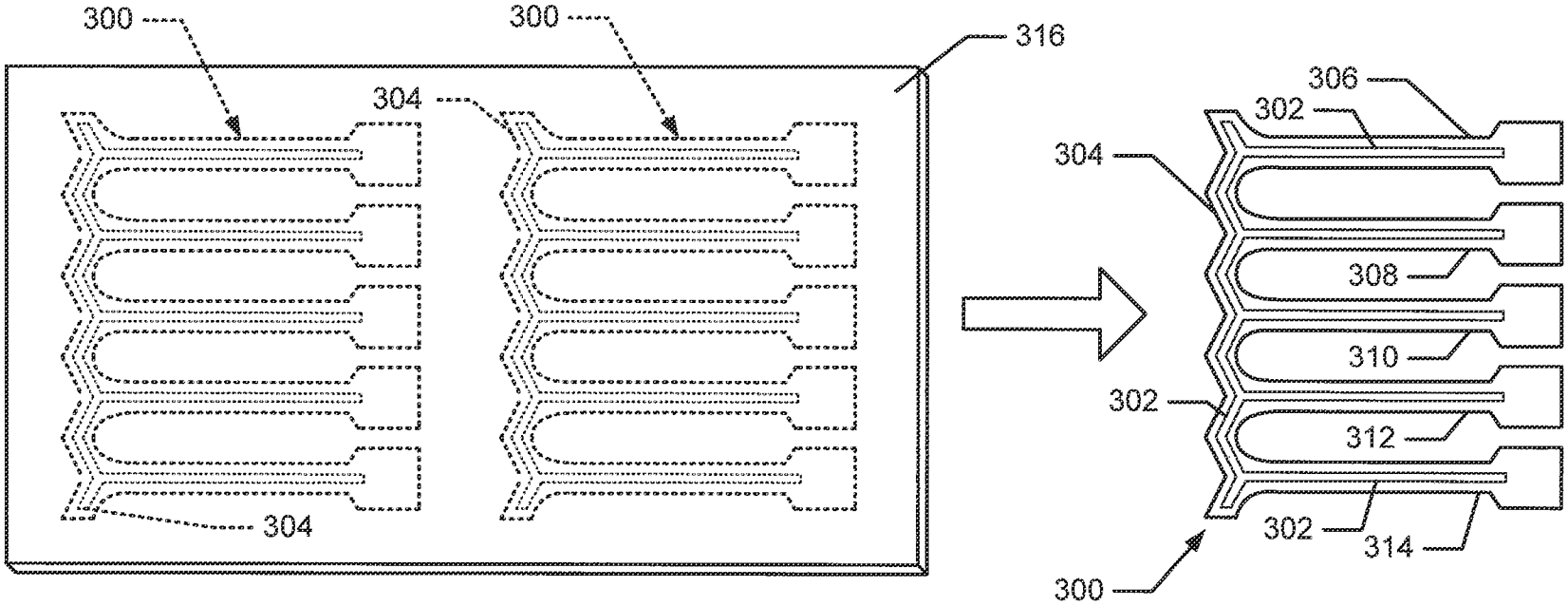
FIGS. 4A through 4F illustrate example steps involved in making a body position feedback system in accordance with some examples of this invention.

The body position feedback system of this example of the invention may be constructed, for example, by the method illustrated in FIGS. 4A through 4F. This example body position feedback system is a multilayer construction that may be separately applied to an existing garment structure (e.g., a shirt, tank top, undergarment, leotard, etc.). FIG. 4A illustrates production of a first layer 300 of the example body position feedback system structure 202*a* of FIGS. 2A and 2B. As shown, in this step, one or more first layer members 300 are cut out from a larger blank or piece of material 316. Any desired type of cutting operation may be utilized without departing from the invention, including, for example, die cutting, laser cutting, hand cutting, and the like. Also, any desired type of material 316 may be used without departing from this invention. In this illustrated example, the material 316 may be a material having a higher modulus of elasticity (e.g., more resistant to tensile stretching forces and/or providing a higher compression force) as compared to that of the fabric elements making up other portions of the garment structure (e.g., compared to the stretch resistance or compressive force applying capability for the spandex, cotton, polyester, or other fabric elements 220 making up the garment structure 200). As some more specific examples, material 316 may be materials commonly used in tackle twill production, a canvas type material, a polyester type material, a thermoplastic polyurethane adhesive material, etc. In some structures, the material 316 will be made from or contain a suitable material so as to allow first material layer 300 to be joined to another material later in the body position feedback system construction process (e.g., by lamination processes, through application of heat and/or pressure, by adhesives, etc.). Additionally or alternatively, if desired, the higher compressive force applying material layer 300 may be made from multiple pieces joined together without departing from this invention (e.g., joined by sewing or stitching; adhesives or cements; mechanical connectors (such as hook-and-loop fasteners); etc.).

This illustrated example structure 300 includes plural extending regions 306, 308, 310, 312, and 314 of high stretch resistance connected by a common base member 304 (e.g., that extends along the central back portion of the garment structure, in this example), like the structure illustrated in FIGS. 2A and 2B. Each individual extended region 306, 308, 310, 312, and 314 of this example structure 300 includes an opening 302 cut therein. If desired, and as illustrated in FIG. 4A, the opening 302 may extend along the common base member 304. While the opening 302 is shown in FIG. 4A as a single continuous opening 302, if desired, the higher compressive force applying material layer 300 may include multiple separated openings without departing from this invention (e.g., as a separate opening extending along each leg 306, 308, 310, 312, and 314, etc.).

Figure 4B:
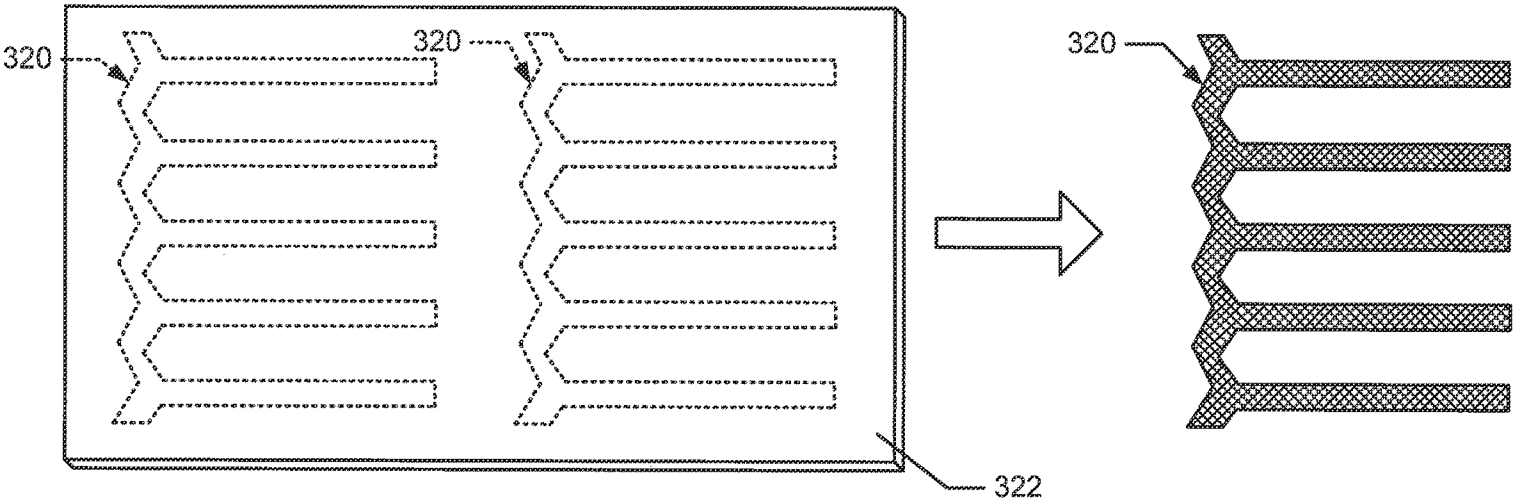

FIG. 4B illustrates another step in this example process for producing body position feedback systems. This step is a material 322 cutting step like that described above in conjunction with FIG. 4A, but in this instance, the material 322 forms a second layer of the overall body position feedback system structure 202*a*. Any desired type of cutting operation, including those described above in conjunction with FIG. 4A, may be used for this step without departing from the invention. In general, the material 322 is cut into one or more second layer members 320 having generally the same size and shape as the first layer member 300, but, if desired, the members 320 may be of somewhat different size (e.g., somewhat smaller) and/or somewhat different shape.

The second material layer 320 may be made from any desired material 322 without departing from this invention, including any type of material conventionally used in garment and apparel manufacture. In at least some examples of this invention, the second material layer 320 will be made from a flexible material, such as cotton, polyester, etc., and optionally from the same material included in at least one of the other fabric elements 220 of the garment structure 200. While in some example structures the second material layer 320 may be made from a material having a higher resistance to stretching than that of the fabric element making up the largest proportion of the garment structure 200 and/or a higher resistance to stretching than the first material layer 300, in this illustrated example structure the second material layer 320 will have the same or a lower resistance to stretching than the first material layer 300. As some more specific examples, the second material layer 320 may be made from a mesh material, such as high performance sweat management materials (e.g., thin, lightweight fabrics made from or containing polyester microfibers, polyester microfiber/cotton blends, polyester microfiber/cotton/spandex blends, polyester/spandex blends, high compression meshes, and the like), such as "Sphere Dry" polyester knit materials and/or a Dn-FIT® polyester materials, e.g., as included in various commercial products available from NIKE, Inc., of Beaverton, Oreg. (this same material or similar materials also may be used as other fabric elements 220 in the overall garment structure 200).

Figure 4C:
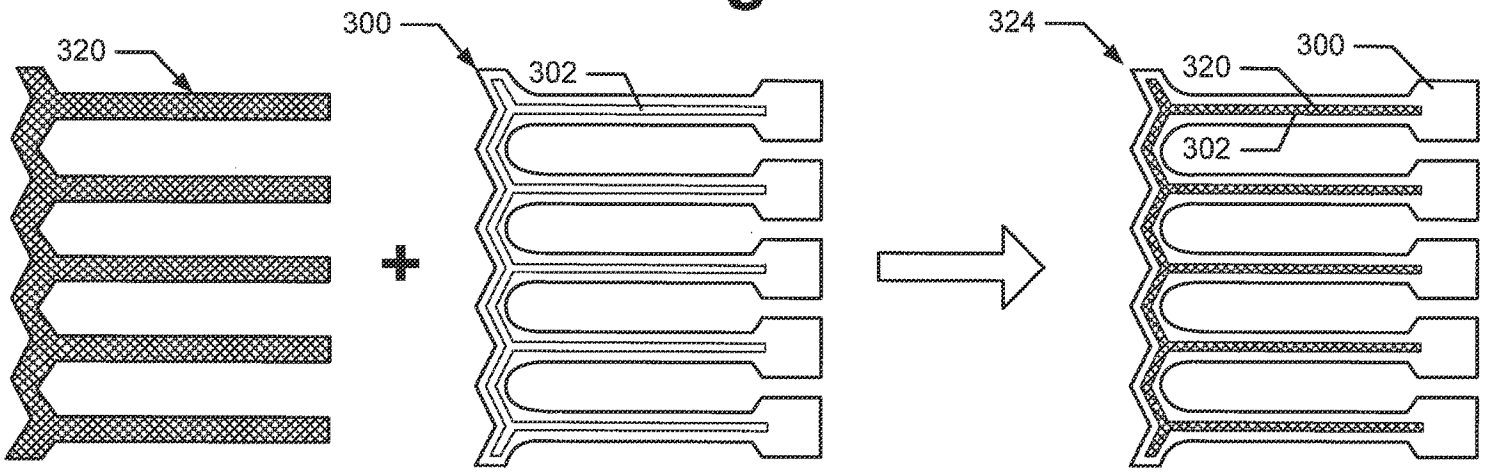

Once the material layers 300 and 320 are cut from their respective blanks 316 and 322, they may be joined to one another as illustrated in FIG. 4C to thereby build a body position feedback base member 324. Any desired manner of connecting these layers 300 and 320 together may be used without departing from this invention, including, for example, one or more of: sewing or stitching; adhesives or cements; lamination processes; etc. As some more specific examples, the layers 300 and 320 may be joined to one another in manners used in conventional tackle twill construction and manufacture. They also may be joined together using heat and pressing technology as is conventionally known and used in the art.

FIG. 4C illustrates that the material of the second layer 320 extends over and covers the openings 302 in the first material layer 300. Using a flexible, lightweight, and/or low compressive force applying material (as compared to material layer 300) and/or a mesh material as the second material layer 320 can provide certain advantages in an overall garment structure including a multilayer body position feedback system of the type constructed by the method of FIGS. 4A through 4F. For example, a lightweight mesh or other material for second material layer 320 can help prevent or reduce excessive heat buildup that may result due to the presence of the first material layer 300 (e.g., if the first material layer 300 is not very air permeable). Additionally or alternatively, if desired, use of a lightweight and/or flexible material for material layer 320 can help the overall body position feedback base member 324 better move and/or flex with the wearer's body (at least in directions other than the general longitudinal or length dimensions of the high stretch resistant material regions), to thereby help avoid uncomfortable bunching, folding, and the like.

FIGS. 4B and 4C illustrate a single second material layer 320 for engaging the first material layer 300 and completely covering all of the openings 302. This is not a requirement. Rather, if desired, plural second material layers 320 may be provided and separately attached to the first material layer 300, e.g., each second material layer piece 320 may cover only one or fewer than all of the openings 302, multiple second material layers 320 may cover a single opening 302, etc. When plural second material layers 320 are present, they may overlap, partially overlap, and/or remain separated from one another without departing from this invention. As yet another example, if desired, the layer 320 may simply be omitted from the structure.

Figure 4D:
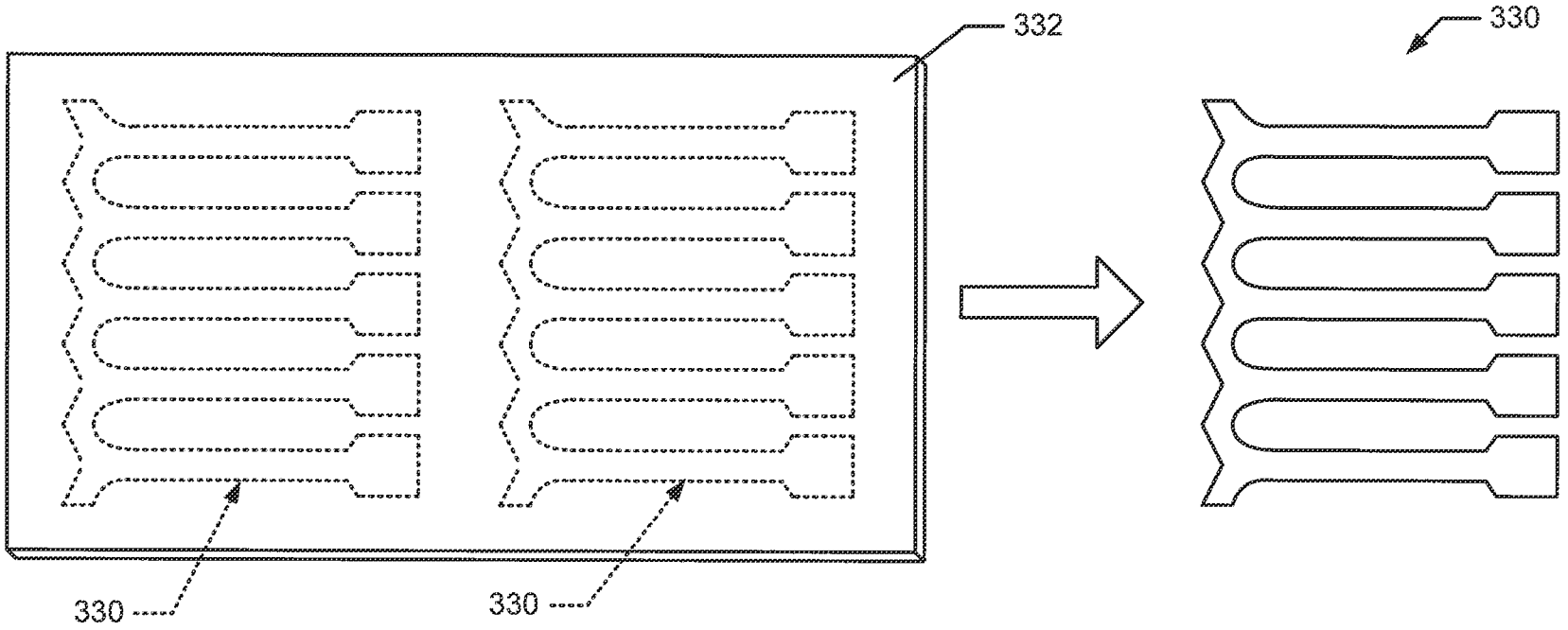

FIG. 4D illustrates production of another material layer 330 that may be incorporated into a body position feedback system in accordance with at least some examples of this invention. This layer 330, a base layer, may be cut from a blank 332 in generally the same size and shape as the first material layer 300 (optionally, a bit larger), using the same or similar techniques to those described above. The base layer 330 may be made from any desired material 332 without departing from this invention, including materials having a higher compressive force application capability than that of the base garment material to which it is attached. Moreover, if desired, the base layer 330 may include openings defined therein, or it may be made from a mesh material, to enhance the air permeability of the overall body position feedback system. Various example features of this base layer 330 will be described in more detail below in conjunction with FIGS. 4E and 4F.

The base layer 330 need not be the same shape as the other layer 300. For example, if desired, the base layer 330 may simply be a relatively large block of material to which the other layers can be easily applied (as described below) without the need to precisely align the various parts. Multipart constructions for base layer 330 (multiple base layer parts to engage a single layer 300) also may be used without departing from this invention.

Figure 4E:
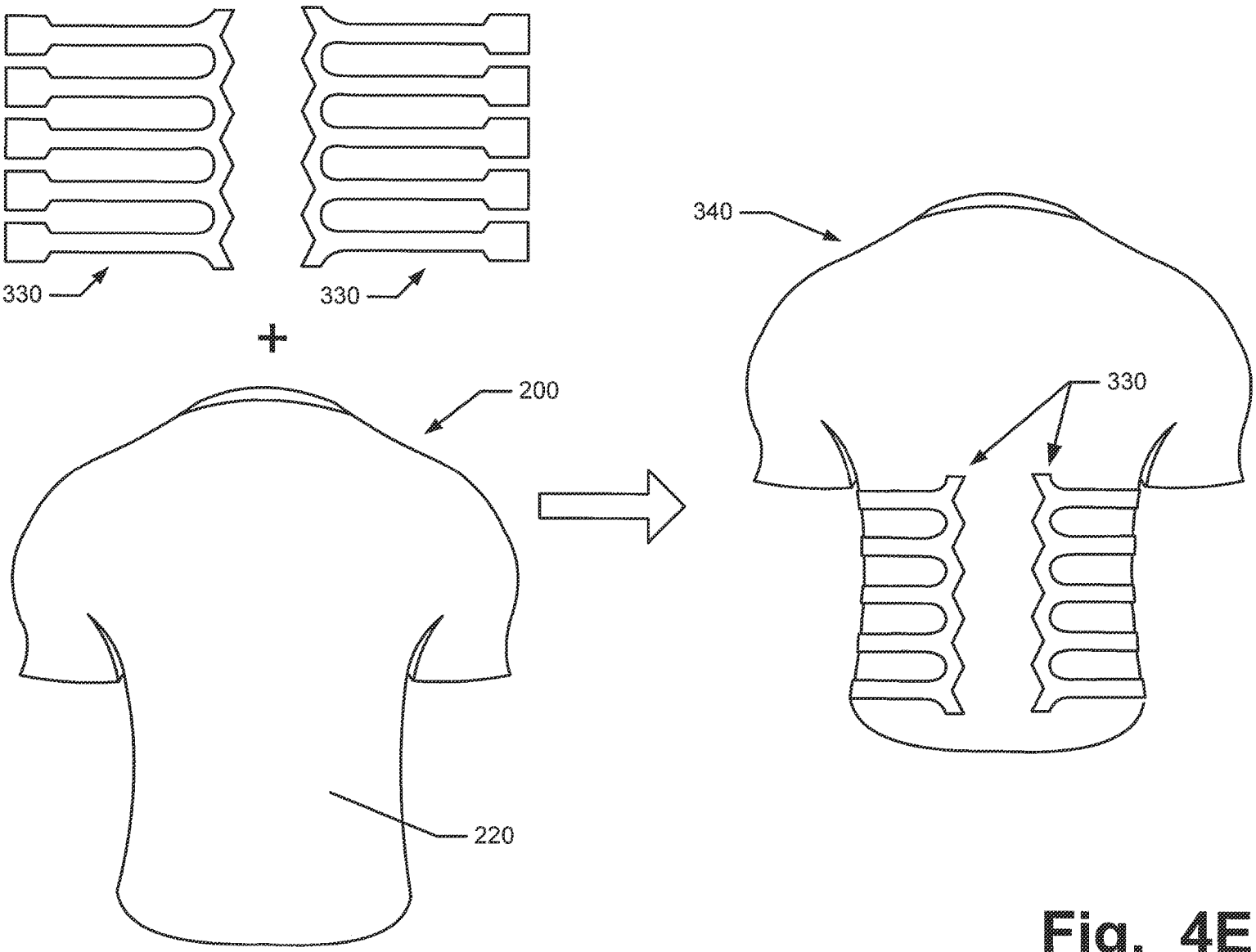

In the next step in this illustrated example procedure, as illustrated in FIG. 4E, one or more base layers 330 are applied to one or more fabric elements of a garment structure, e.g., like fabric elements 220 of garment structure 200 described above in conjunction with FIGS. 2A and 2B. Any manner of applying the base layer 330 to the fabric element(s) 220 may be used without departing from this invention. For example, if desired, one surface of the base layer 330 may include (or be treated to include) adhesives or other materials to enable the base layer 330 to be applied to the fabric element(s) 220 using heat, pressure, and/or other adhesive curing and/or lamination techniques. As other examples, the base layer 330 may be engaged with the fabric element(s) 220 by sewing or stitching, by mechanical connectors (such as hook-and-loop fasteners), and the like. The combined garment structure 200 with the base layer 330 applied thereto is illustrated in FIG. 4E by reference number 340.

Figure 4F:
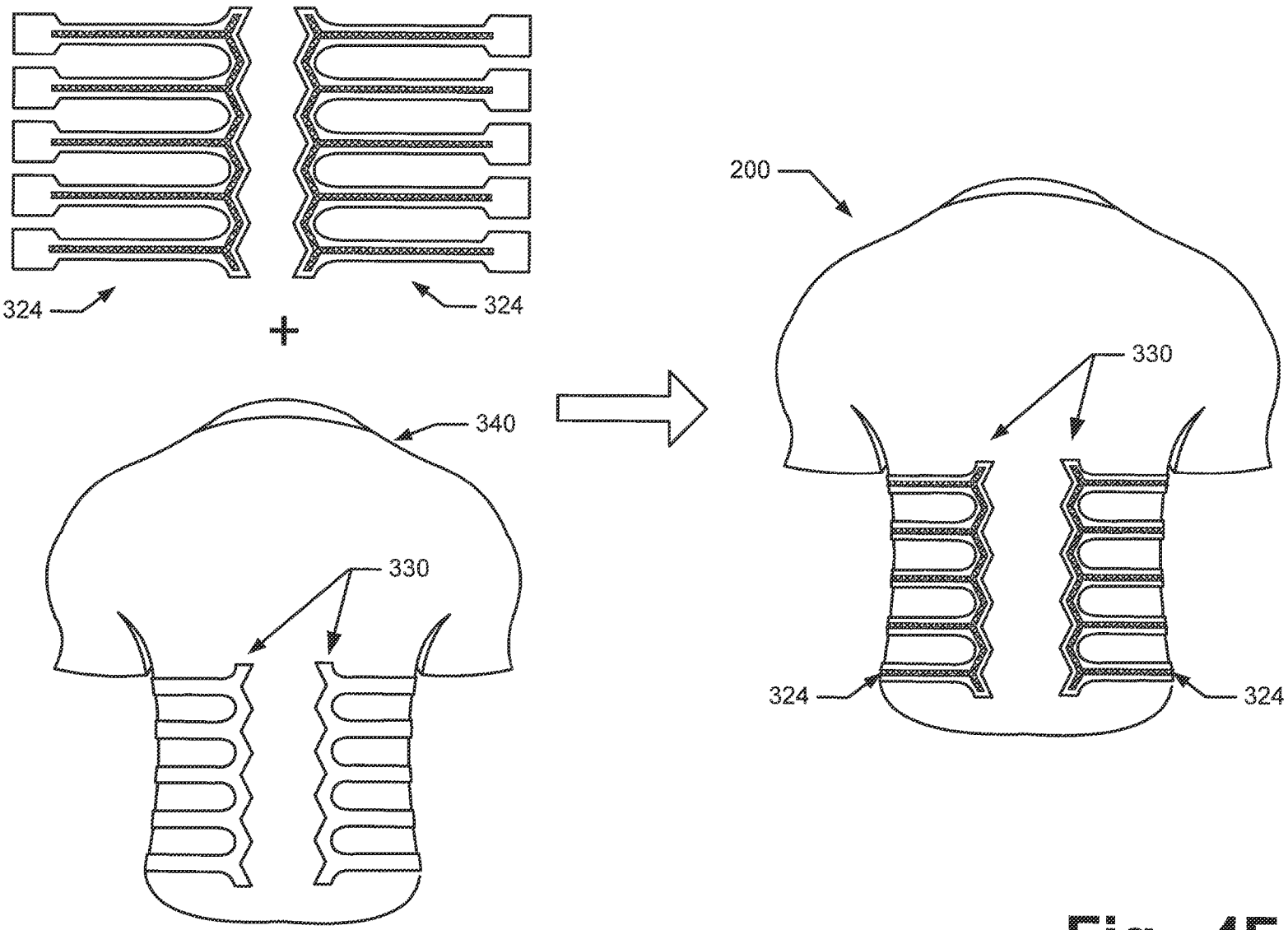

Next, as illustrated in FIG. 4F, the body position feedback base 324 is engaged with the garment base structure 340 over the base layer 330 to produce the final garment structure (e.g., like the garment structure 200 illustrated in FIGS. 2A and 2B). Any desired manner of engaging the body position feedback base 324 with the base layer 330 on the garment base structure 340 may be used without departing from this invention. For example, if desired, the exposed surface of the base layer 330 may include adhesives or other materials (or treated to include such materials) to enable the body position feedback base 324 to be applied to the base layer 330 using heat, pressure, and/or other adhesive curing and/or lamination techniques. As other examples, the body position feedback base 324 may be engaged with the base layer 330 by sewing or stitching, by mechanical connectors (such as hook-and-loop fasteners), and the like. In one example structure, base layer 330 and first material layer 300 (included in base 324) will be made and/or include materials that allow them to be engaged together, e.g., using heat, pressure, and/or lamination processes. The base layer 330 and the first material layer 300 also may be made from thermoplastic polymeric materials of the type commercially available from Bemis Associates, Inc. of Shirley, Mass., United States, and they may be held together by the adhesive properties of these Bemis materials. Thermoplastic polyurethane adhesive materials, Gorilla Grip materials, and/or materials commercially available from Framis Italia SpA (of Gaggiano, Italy) also may be used for such multi-layered laminated structures.

Those skilled in the art will appreciate that the various methods described above may be varied significantly without departing from this invention. For example, while various independent steps are described in conjunction with FIGS. 4A through 4F, the steps may be changed in order, combined, include additional features, performed simultaneously, performed by one or more independent parties, or the like, without departing from this invention. For example, if desired, the multi-layered body position feedback system may be fully constructed independent of the garment structure and then, after its complete construction (e.g., including all layers), it may be applied to the garment structure as a single element (e.g., in a single lamination, heating, and/or pressing step, via sewing, etc.). As another example, if desired, the entire feedback system structure may be built up using the garment as an initial base material (e.g., first applying the base layer 330 to the garment, applying the second layer 320 to the base layer 330, and then applying the first layer 300 over the second layer). As yet another example, if desired, one or more of the layers (e.g., base layer 330, second material layer 312, etc.) may be omitted without departing from the invention. If desired, a single layer alone (e.g., layer 330 or layer 300) may form the entire body position feedback structure. Other modifications also are possible.

When the overall body position feedback system is less air permeable than other fabric elements of the garment structures (including the fabric elements immediately adjacent the feedback system), this can have an advantageous tactile effect. The decreased air permeability of the higher compressive force applying regions can cause some localized sweating at these areas. The differential created by the presence of sweat in the higher sweating areas can further enhance the differential feel, and thus the wearer's feel and awareness of these portions of his/her body.

Figure 5:
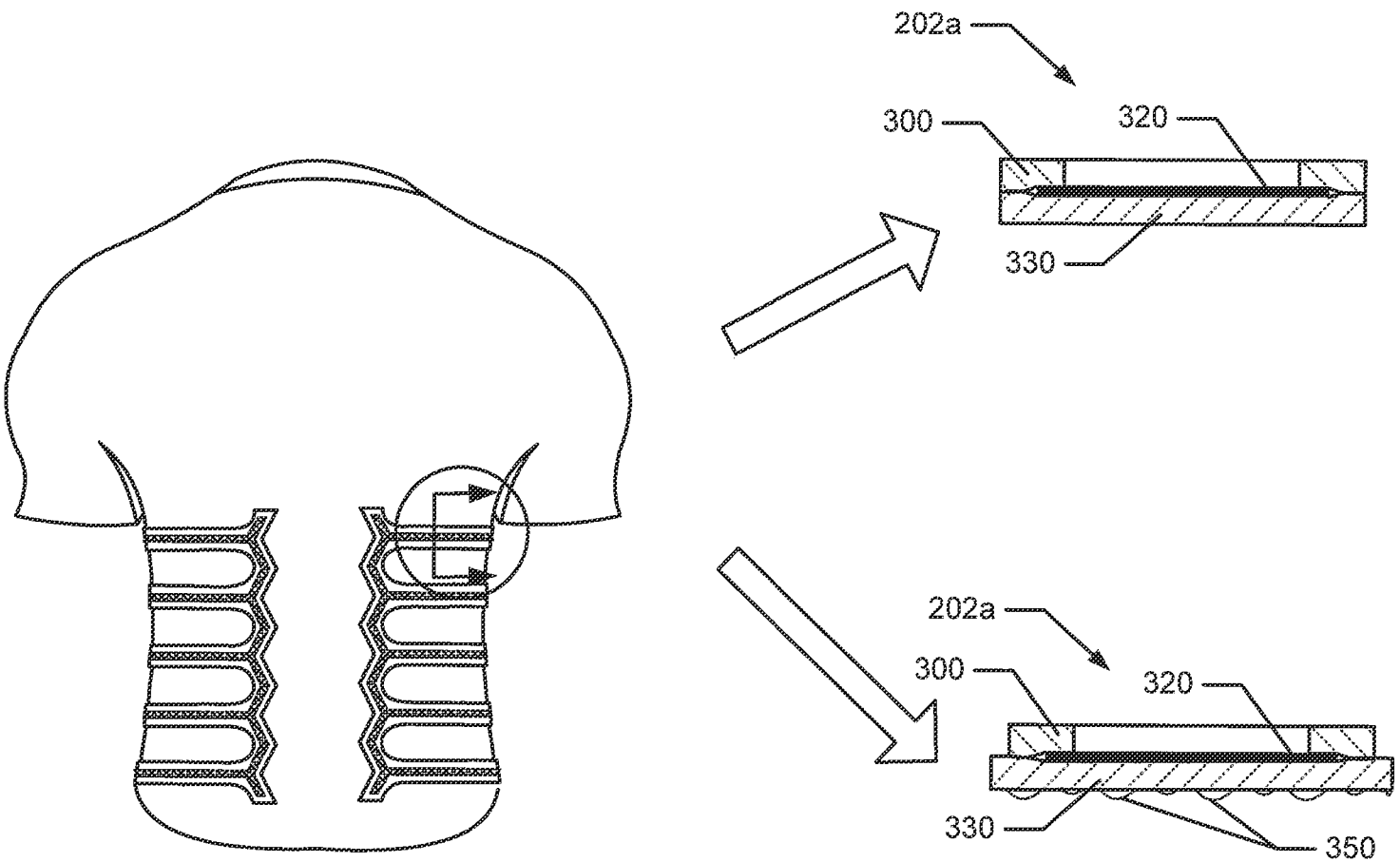
FIG. 5 illustrates more detailed views of various features that may be included in body position feedback systems in accordance with some examples of this invention.

FIG. 5 illustrates cross sectional views of various examples of attachable body position feedback systems in accordance with this invention, e.g., of the multi-layer types described above in conjunction with FIGS. 2A through 4F. The upper cross sectional view in FIG. 5 illustrates the body position feedback system 202*a* in which the first material layer 300 and the base layer 330 are substantially the same size and shape, and the second material layer 320 is sandwiched between these layers. As illustrated in the upper portion of FIG. 5, the second material layer 320 is somewhat smaller than the other layers, which leaves the outer edges of the first material layer 300 and the base layer 330 exposed so they may be joined together with one another (e.g., by adhesives or cements, by lamination techniques, by stitching or sewing, etc.). The bottom cross sectional view in FIG. 5, on the other hand, shows the base layer 330 somewhat larger than the first material layer 300 (and extending beyond the edges of the first material layer 300). The first material layer 300 is somewhat larger than the second material layer 320 (and the second material layer 320 is sandwiched between the first material layer 300 and the base layer 330). Again, any desired method of joining the various layers together may be used without departing from this invention including the methods described above in conjunction with the upper cross sectional portion of FIG. 5. This structure, if desired, may be used to produce a body position feedback system 202*a* having a tackle twill type appearance in its final structure.

FIG. 5 illustrates another optional feature that may be included in garment structures and/or body position feedback systems in accordance with at least some examples of this invention. As illustrated in the bottom cross sectional view of FIG. 5, one or more layers of the body position feedback system 202*a* may include "texturing" features or elements. The texturing is shown in FIG. 5 by raised areas 350 extending from the bottom of base layer 330. Texturing of this type may further enhance the wearer's "feel" of the body position feedback system 202*a*, better stimulate the nerves and deep tissue receptors, etc. The raised areas 350 may be provided on any desired surface or layer of the body position feedback system 202*a* (and/or on any portion thereof), and they may be any desired size or shape (e.g., raised at least 1 mm, at least 2 mm, at least 3 mm, at least 5 mm, or even at least 8 mm, with respect to the base surface level of the layer with which they are included (e.g., layer 330 in FIG. 5)). The raised areas 350 may be integrally formed as part of the layer structure 330 (e.g., molded or embossed therein) or applied thereto as separate elements (e.g., printed thereon, silicone dot elements applied thereto, mechanical fastener elements or portions thereof (e.g., male snap elements), etc.). While the texturing 350 may be uniformly and evenly applied across the layer of material, it also may be concentrated at specific locations, including present in multiple, discrete locations at one or more portions of the layer of material to which it is applied.

Aspects of this invention may be used in conjunction with any desired garment type or style without departing from this invention. Various examples of inclusion of body position feedback systems in garment structures are illustrated in conjunction with FIGS. 6A through 11C. These figures are described in more detail below.

Figure 6A:
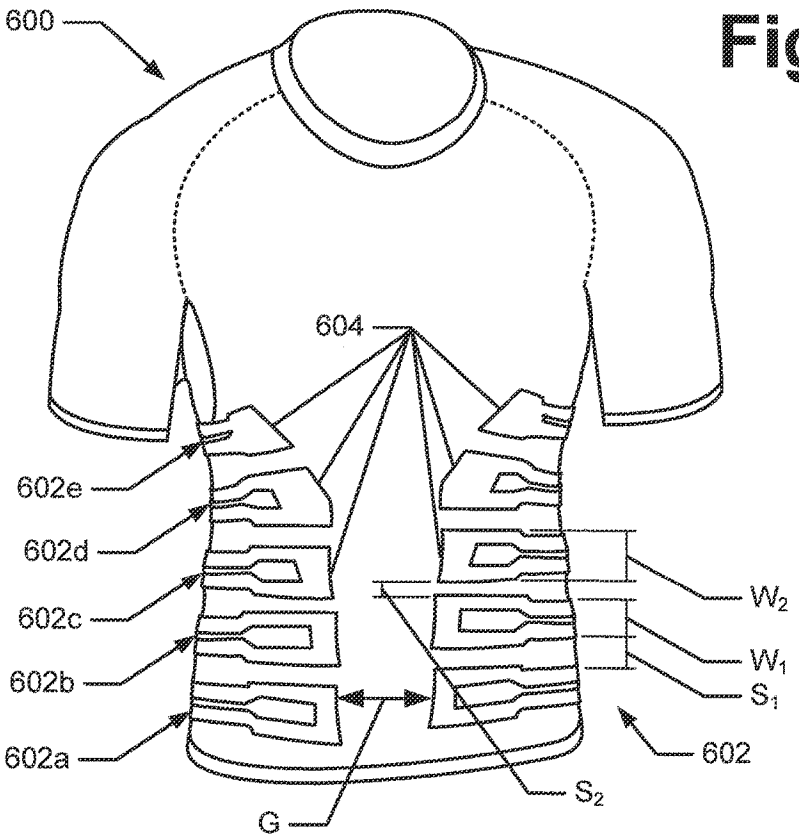
FIGS. 6A through 11C illustrate additional example body position feedback systems and their application to garment structures.
Figure 6B:
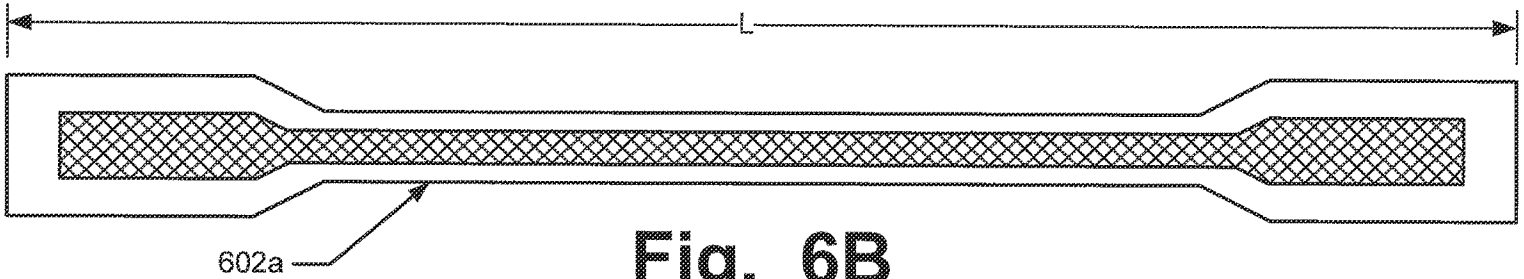

FIG. 6A illustrates a garment structure 600 that includes a lower body core position feedback system 602. The lower body core position feedback system of FIGS. 2A and 2B included two feedback systems 202*a* and 202*b*, one arranged on each side of the wearer's body (with the connected base members 204 extending along the sides of the central back portion of the garment structure). The free arms of those feedback systems 202*a* and 202*b* extended from their respective base members 204, around the garment sides, and to a central front portion of the garment structure. In the example of FIGS. 6A and 6B, the feedback system 602 includes multiple separate bands 602*a* through 602*e* that extend almost completely around the garment structure 600, from one central front side of the garment structure 600 to the other central front side. If desired, as illustrated in FIG. 6A, a gap G may remain between the free ends 604 of each of the bands 602*a* through 602*e*.

Any desired gap distance G may be maintained without departing from this invention, including, for example, gaps within the range of 1 cm to 40 cm, and in some examples, from 2 cm to 20 cm, or even from 5 cm to 15 cm. The bands 602*a* through 602*e* may have any desired widths W, and may be separated from one another by any desired separation distances S, including, for example, the widths $W_1$ and $W_2$ and separation distances $S_1$ and $S_2$ described above with reference to FIGS. 3A and 3C. The bands 602*a* through 602*e* also may have any desired overall length L, e.g., depending on the garment size and the desired circumferential expanse, such as from 15 cm to 120 cm, and in some examples, from 25 cm to 100 cm or even from 30 cm to 75 cm. The gap distance G, leg widths W, separation distances S, and leg lengths L may be constant or may vary within the various feedback devices 602 provided on an individual garment structure 600.

If desired, the bands 602*a* through 602*e* may extend around the garment structure 600, always maintaining at least some separation between the individual bands 602*a* through 602*e*. Alternatively, if desired, at least some of the bands 602*a* through 602*e* may cross one another and/or overlap one another, without departing from this invention. Also, if desired, the bands may extend only approximately halfway around the garment structure 600 (e.g., in an arrangement like that shown in FIGS. 2A and 2B, but without the connecting base portion 204 connecting the individual legs). The bands 602*a* through 602*e* may be made of any desired material(s), including the various materials described above for the multilayered construction of FIGS. 4A through 4F, and, if further desired, the bands 602*a* through 602*e* may be engaged with the material of the garment structure 600 in the same manners as described above.

Figure 7D:
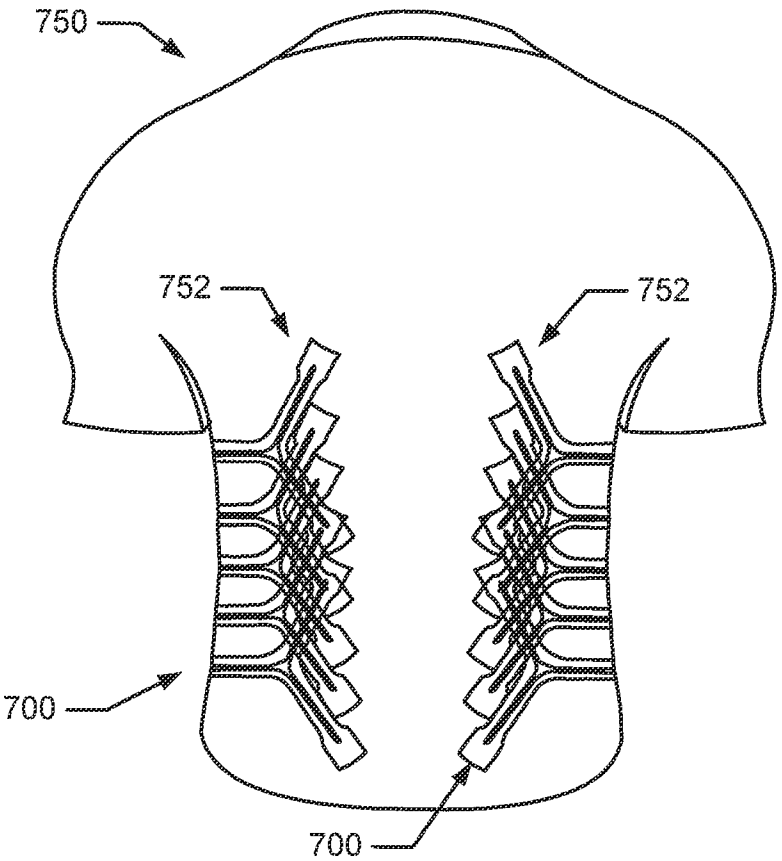

FIGS. 7A through 7D illustrate another body position feedback device 700 and its inclusion in a garment structure 750. In this example structure, the feedback device 700 has a multi-legged structure 704 (e.g., three legs 704 in this illustrated example) extending from a base area 702. If desired, the internal areas of the legs 704 and the base area 702 may include one or more openings 706 defined therein. While the feedback device 700 may be made from any desired material and construction that has resistance to stretching and/or compressive force application capabilities, if desired, at least some of the feedback devices 700 may have a multi-layered construction, e.g., like that described above in conjunction with FIGS. 4A through 4F (e.g., the openings 706 may be covered by a mesh or other material layer, if desired). Also, if desired, the feedback device 700 may be engaged with the material of the garment structure 750 in the same manners as described above. While FIG. 7A shows the various legs 704 of substantially the same length and appearance, if desired, the legs 704 may be of different lengths, and they may have different constructions (e.g., the leg 704 extending around in substantially the horizontal circumferential direction may be somewhat longer than one or more of the other legs 704).

Figure 7C:
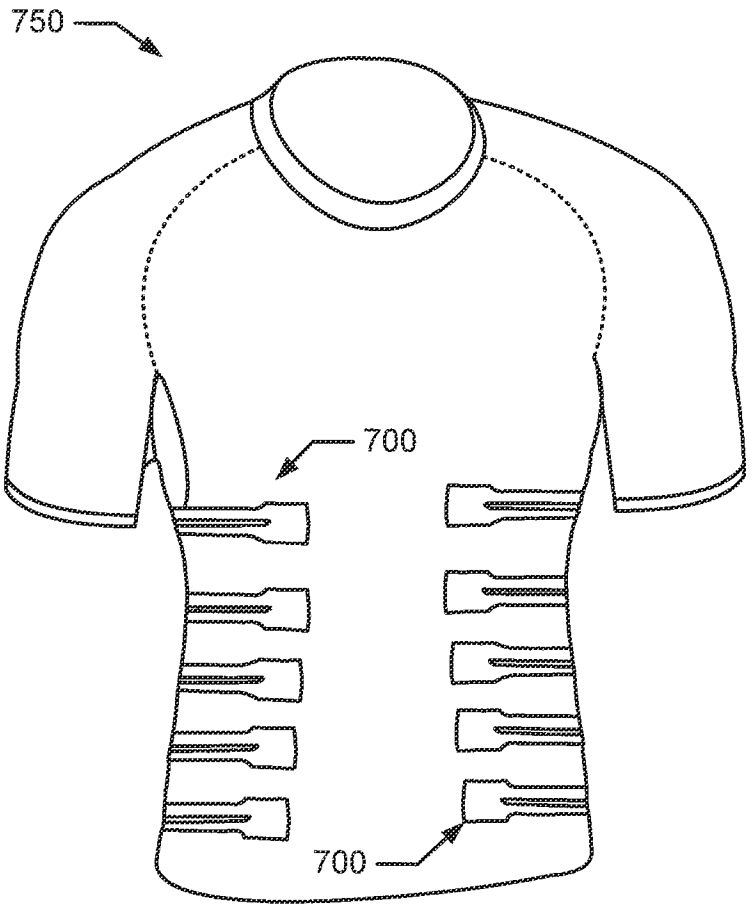

FIGS. 7B through 7D illustrate an example arrangement of plural feedback devices 700 on a garment structure 750. As shown, in this example structure, two legs of the various feedback devices 700 overlap one another along the central rear sides of the garment structure 750, thereby providing a substantially continuous base area 752 along each side of the central spine. A plurality of individual legs 704 extend substantially horizontally out from this base area 752 around a substantially horizontal circumference of the garment structure 750. The overlapping base area 752 provides great compressive force application capability and resistance to stretching while leaving the legs 704 and their free ends separated from one another to provide good feel differential and body position feedback sensory information.

Any desired gap distance G, widths W, separation distances S, and leg lengths L may be provided without departing from this invention, including, for example, the gaps, widths (including widths $W_1$ and $W_2$), separation distances (including separation distances $S_1$ and $S_2$), and leg lengths L (including leg lengths $L_1$ and $L_2$), described above in conjunction with FIGS. 2A through 4F. The gap distance G, leg widths W, separation distances S, and leg lengths L may be constant or may vary within the various feedback devices 700 provided on an individual garment structure 750.

The feedback devices 700 may be made of any desired material(s), including the various materials described above for the multilayered construction of FIGS. 4A through 4F. Further, while any manner of engaging the feedback devices 700 with the garment structure 750 may be used without departing from this invention, if desired, the feedback devices 700 may be engaged with the material of the garment structure 7500 in the same manners as described above.

Figure 8B:
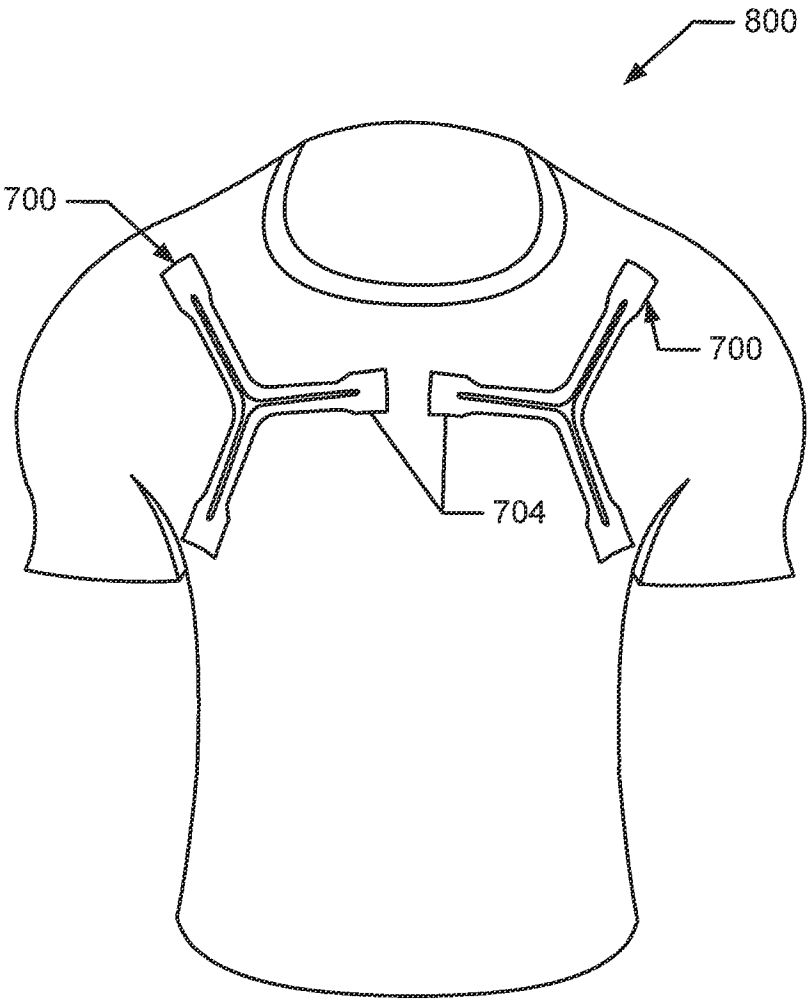
Figure 8A:
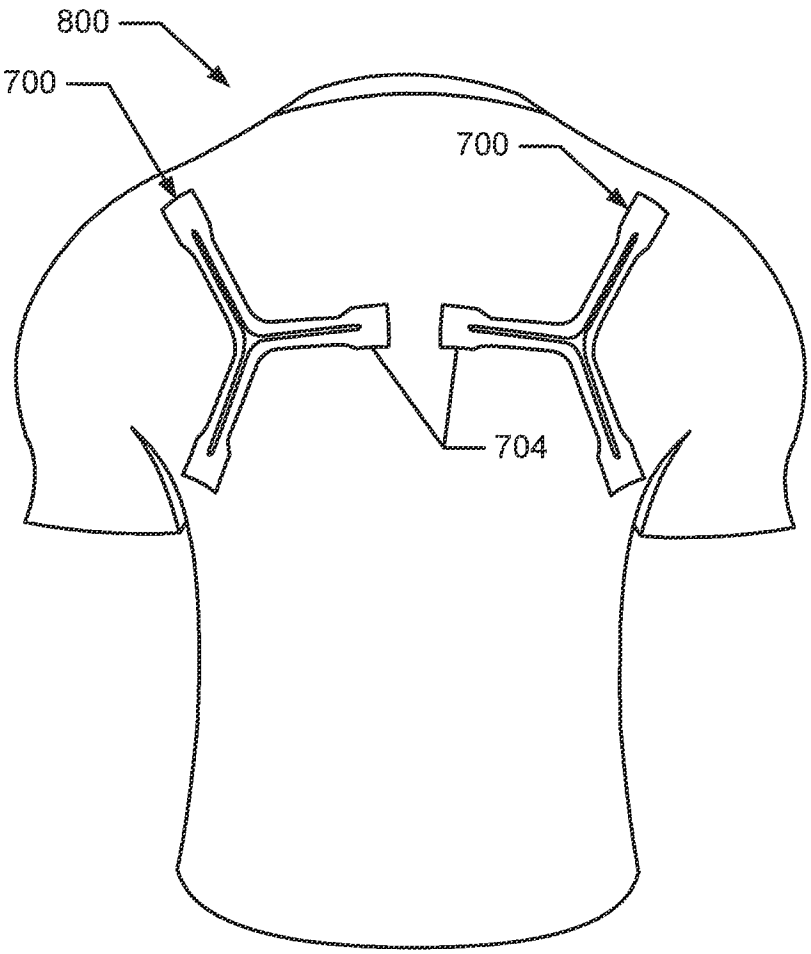

The feedback device 700 of FIGS. 7A through 7D is not limited for use in the lower core (lower back and/or abdomen) regions. Rather, as illustrated in FIGS. 8A and 8B, this same general feedback device structure 700 may be used to provide a garment 800 in which enhanced feedback is provided regarding the positioning of the wearer's upper back, shoulders and chest. While a variety of configurations are possible without departing from this invention, in this illustrated example, four feedback devices 700 are mounted on the garment 800, two devices 700 on each shoulder, one on the front and one on the back. The feedback devices 700 are multi-legged (e.g., three legs) and of the same general sizes and shapes (although the feedback devices 700 on a given garment structure 800 need not have the same general sizes and/or shapes). In the illustrated example garment 800, the two rear feedback devices 700 each have a leg 704 extending substantially horizontally and toward the center back region, and the two front feedback devices 700 each have a leg 704 extending substantially horizontally and toward the center chest region. The other legs 704 of the devices 700 generally extend in the vertical direction, toward the top of the shoulder and toward the armpit area of the garment structure 800. The garment structure 800 provides excellent feedback regarding the positioning of the wearer's arms and shoulders during the course of an activity.

The body position feedback device of FIG. 7A need not be limited for use in the lower back, abdomen, and/or shoulder areas. Rather, if desired, similar structures may be positioned on articles of clothing for other parts of the body, such as near the ankles, calves, knees, thighs, waist, hips, arms, elbows, wrists, neck, etc.

Figure 9:
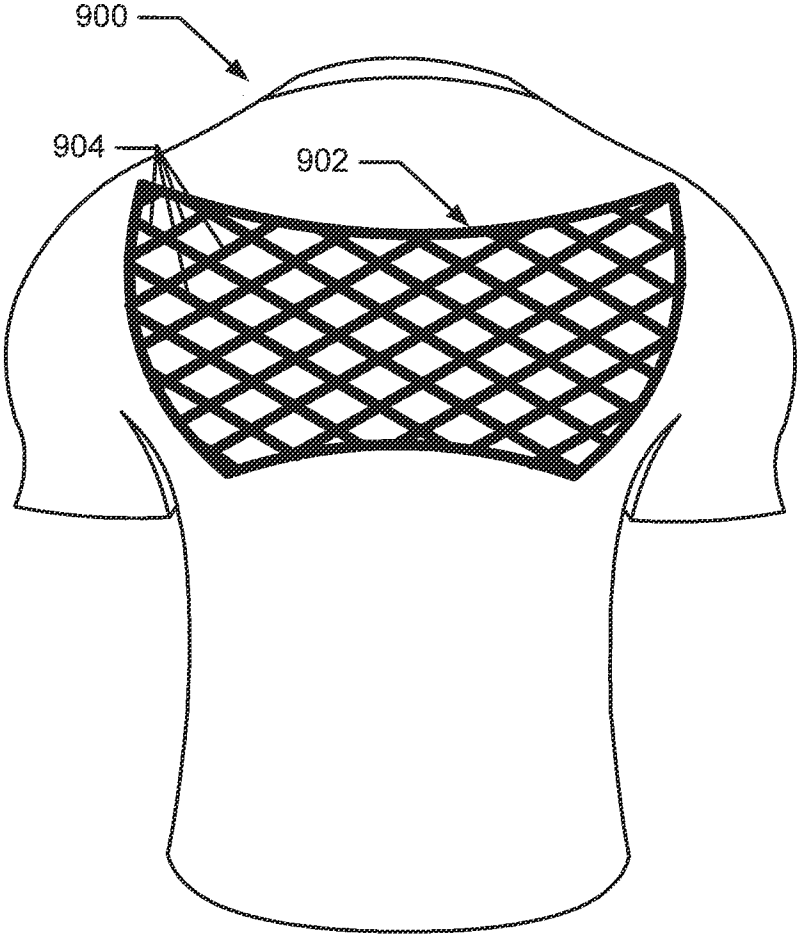

FIG. 9 illustrates another body position feedback device 902 on a garment structure 900. This feedback device 902 is arranged in the upper back and shoulder areas and spans continuously across the upper back from one shoulder area to the other shoulder area. In this example structure 900, the feedback device 902 is in the form of a matrix, with plural bands 904 extending in substantially diagonal directions across the structure 902. The bands 904, which may be made from a material having compressive force application capability or resistance to stretching, cross one another to create the matrix type structure. The area between the bands 904 helps create the feel "differential" described above and enable the wearer to better "feel" the positioning of the shoulders and upper back.

While any desired spacing between the bands 904 may be maintained without departing from this invention, in accordance with at least some examples of this invention, the generally parallel bands 904 may be spaced apart by at least 2 cm, and in some examples, within the range of 2 cm to 16 cm, or even within the range of 4 cm to 10 cm.

The bands 904 within a given garment structure 900 may have the same or different compressive force application capability or resistance to stretching without departing from this invention. As some examples, the compressive force application capability may change over the area of the overall feedback device structure 902, or the bands 904 extending in one direction may have a different compressive force application capability or resistance to stretching as compared to the bands 904 extending in another direction.

The feedback device 902 may have any desired construction without departing from this invention, including a single layer construction (such as a single urethane film lamination directly on the garment structure at the desired location(s)) or a multi-layered construction (such as those described above). Also, the feedback device 902 may be engaged with the underlying garment material in any desired manner without departing from this invention, including the various manners described above.

Figure 10:
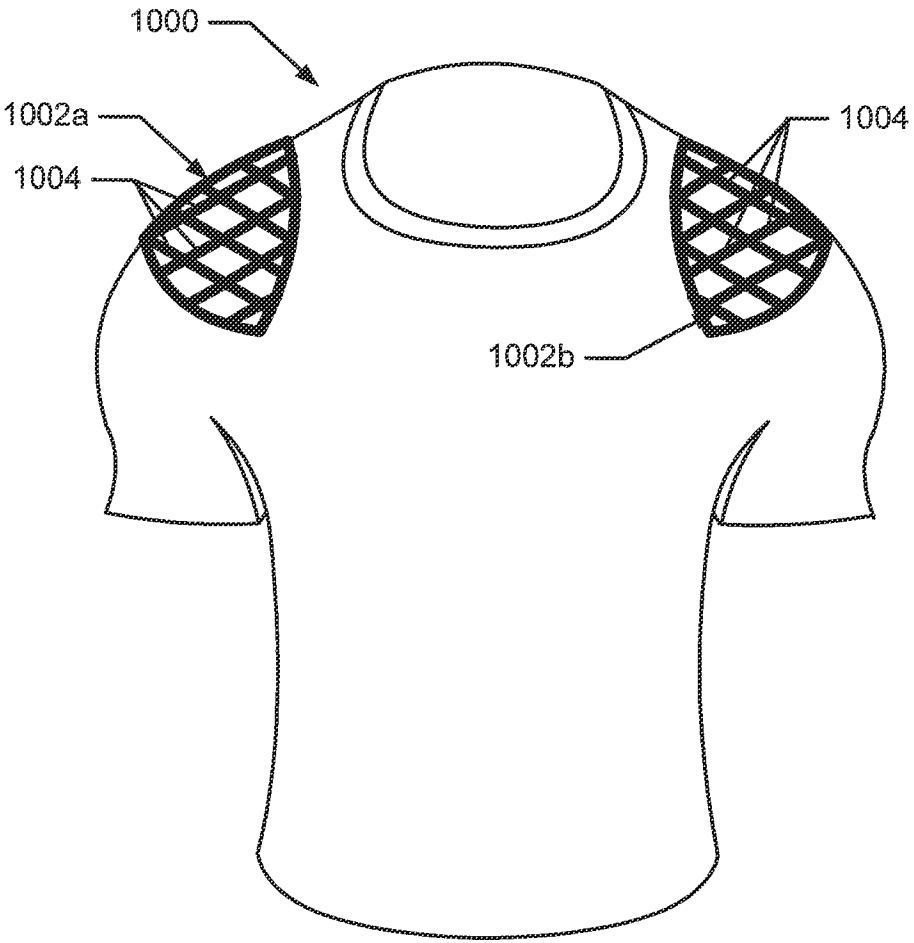

FIG. 10 illustrates another body position feedback device arrangement for the shoulder area of a garment structure 1000. This feedback device arrangement includes two portions, one portion 1002*a* provided on one shoulder and another portion 1002*b* provided on the other shoulder. If desired, these two portions 1002*a* and 1002*b* may be maintained separately, or they may be joined together across the upper back portion (e.g., in an arrangement like that shown in FIG. 9). Again, in this example structure, the feedback devices 1002*a* and 1002*b* are in the form of matrices, with plural bands 1004 extending in substantially diagonal directions across the structures 1002*a* and 1002*b*. The bands 1004, which may be made from a material having compressive force application capability or resistance to stretching, cross one another to create the matrix type structure. The area between the bands 1004 helps create the feel "differential" described above and enable the wearer to better "feel" the positioning of the shoulders and upper back.

While any desired spacing between the bands 1004 may be maintained without departing from this invention, in accordance with at least some examples of this invention, the generally parallel bands 1004 may be spaced apart by at least 2 cm, and in some examples within the range of 2 cm to 16 cm, or even within the range of 4 cm to 10 cm.

The bands 1004 within a given garment structure 1000 may have the same or different compressive force application capability or resistance to stretching without departing from this invention. As some examples, the compressive force application capability may change over the area of the overall feedback device structure 1002*a* and 1002*b*, or the bands 1004 extending in one direction may have a different compressive force application capability or resistance to stretching as compared to the bands 1004 extending in another direction.

The feedback devices 1002*a* and 1002*b* may have any desired construction without departing from this invention, including a single layer construction or a multi-layered construction as described above. When separate devices, the feedback devices 1002*a* and 1002*b* may be the same or different without departing from this invention. Also, the feedback devices 1002*a* and 1002*b* may be engaged with the underlying garment material in any desired manner without departing from this invention, including the various manners described above.

While the bands 904 and 1004 may be individually formed and separate from one another within a single matrix structure 902 and 1002 (e.g., joined to a common perimeter member), respectively, other structures are possible. For example, if desired, the entire devices 902 and 1002 may be formed as single pieces without departing from this invention.

Figure 11A:
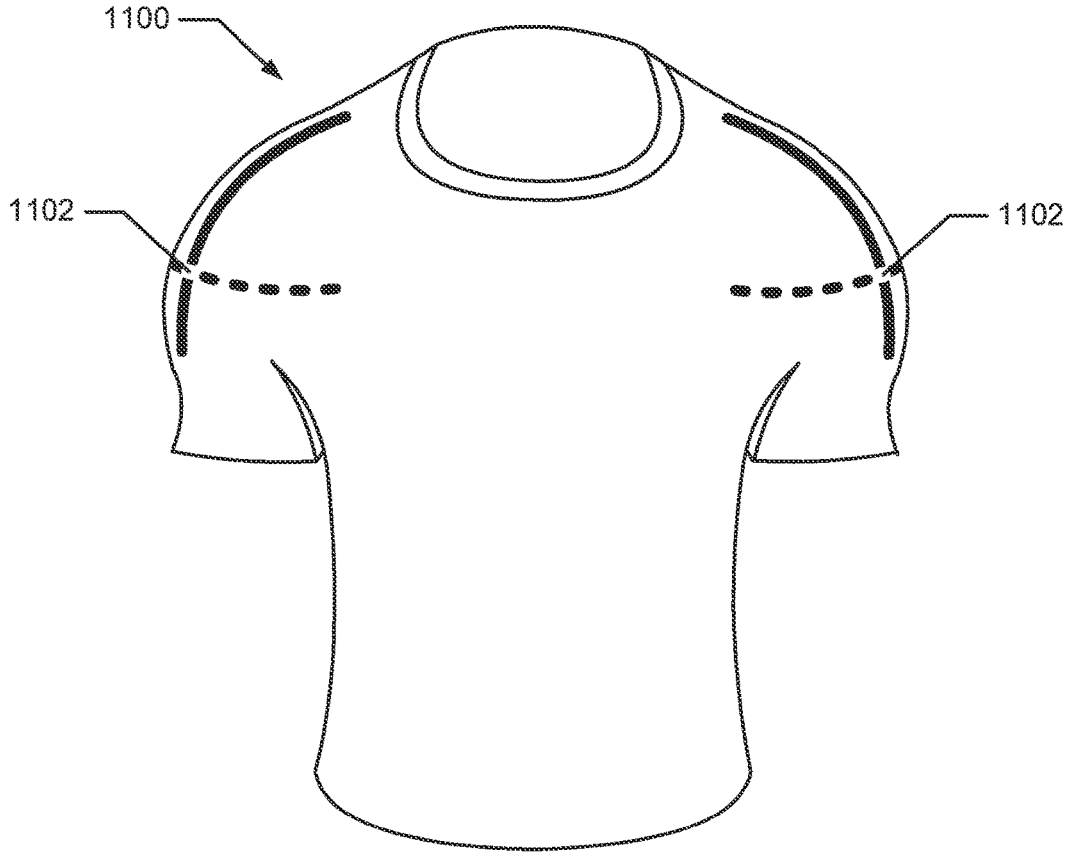
Figure 11B:
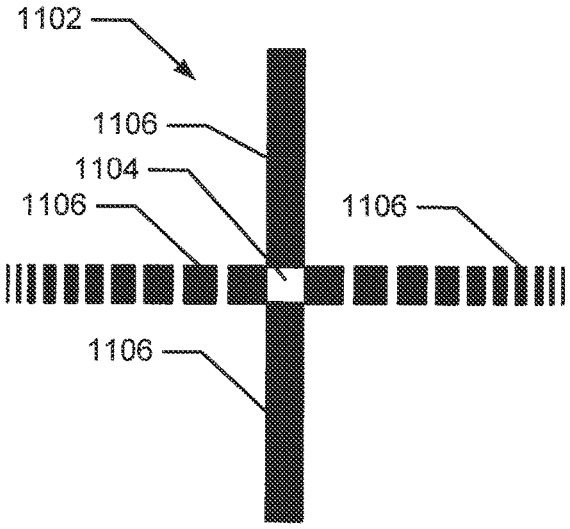
Figure 11C:
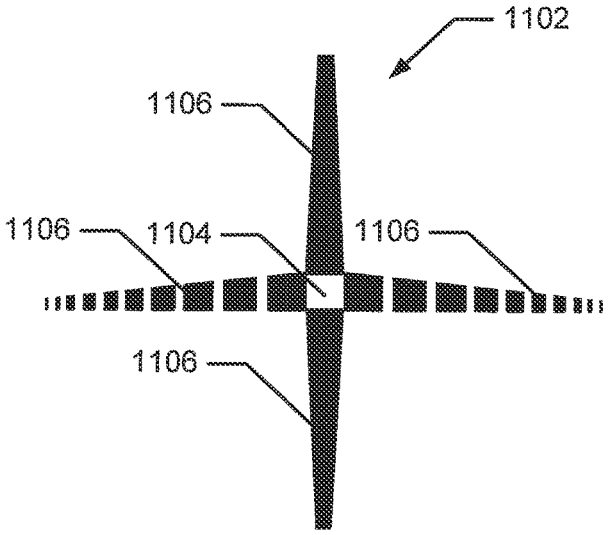

FIGS. 11A through 11C illustrate additional examples of body position feedback systems 1102 that may be included in garment structures 1100 in accordance with this invention. The feedback systems 1102 in these examples are generally cross-shaped (e.g., four legs 1106 extending from a central base area 1104). As shown in FIG. 11A, these body position feedback systems 1102 are arranged in the shoulder areas of the garment structure 1100 such that two legs 1106 extend from the top shoulder area down the sleeve and two legs 1106 extend in a transverse direction across the first two legs 1106 at the base area 1104. While any desired leg structures 1106 are possible, in the illustrated examples, two of the legs 1106 are continuous (the ones extending from the shoulder to the sleeve) and two of the legs 1106 are discontinuous. While any central base area 1104 structure is possible, in these example structures 1102, the central base area 1104 constitutes a discontinuity between the individual legs 1106. The main difference between the feedback systems of FIGS. 11B and 11C relates to the tapered side walls of the legs 1106.

The legs 1106 may be made from a material having compressive force application capability or resistance to stretching. The areas between the legs 1106, the open central base area 1104, and the discontinuities in the legs 1106 (if any) help create the feel "differential" described above and enable the wearer to better "feel" the positioning of the shoulders and arms. The legs 1106 within a given garment structure 1100 may have the same or different compressive force application capability or resistance to stretching without departing from this invention. As some examples, the compressive force application capability may differ for the two shoulders, or the vertical legs 1106 may have different compressive force application capability or resistance to stress properties from the horizontal legs 1106.

The feedback devices 1102 may have any desired construction without departing from this invention, including a single layer construction or a multi-layered construction as described above. Also, the feedback devices 1102 may be engaged with the underlying garment material in any desired manner without departing from this invention, including the various manners described above.

FIGS. 10 and 11A illustrate another feature that may be provided in garment structures in accordance with at least some examples of this invention. As shown in these figures, the feedback devices 1002*a*, 1002*b*, and 1102 may have a contrasting color from the portion of the garment structure 1000 and 1100 to which it is attached. This feature can help the wearer better visually see the feedback devices 1002*a*, 1002*b*, and 1102, which can provide a visual clue or visual information to help the wearer return repeatedly to the same posture or body positioning. For example, in addition to tactilely feeling aspects of the body's positioning due to the compressive force application or resistance to stretch, the color contrast can help the wearer better see features of the body's position, such as the torso's turn, the shoulder's roll, etc.

The compressive force application areas or stretch resistant areas described above in conjunction with FIGS. 2A through 11C are of types that may be separately formed from and/or separately attached to an existing garment structure. This is not a requirement. Other example body position feedback systems in accordance with this invention may take the form of different materials, different stitch arrangements, different knitting constructions, and/or different weaving constructions that are integrally incorporated into the material making up the garment structure, e.g., during knitting, weaving, or sewing processes used in forming the garment. As some more specific examples, the different region(s) or material layer(s) providing the higher compressive force application capability or resistance to stretch may be integrally provided, for example, by incorporating different materials (materials having different elasticities) into the garment structure at selected locations; by using different stitching, knitting, or weaving patterns; by providing different material thicknesses and/or texturing; etc.

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1 through 11C may be used individually and/or in any combination or subcombination without departing from this invention.

Additionally, aspects of this invention can be extended to use with other garment structures and garment structures designed for providing feedback information for different targeted areas of the body (e.g., any of the zones illustrated in FIG. 1). As some more specific examples, aspects of this invention may be extended for use with garment structures specifically designed and tailored to provide position feedback information to the wearer relating to positioning of at least portions of the hands, feet, ankles, calves, knees, arms, elbows, shoulders, abdomen, sacrum or other portions of the back, core, hips, neck, etc. Any type of garment structure that tightly fits against, wraps around, and/or at least partially contains one or more of these portions of the body may be provided in accordance with examples of this invention. Also, garment structures incorporating aspects of the invention may be developed for use in a wide variety of sports, athletic performances, and/or other activities, including any activity where proper body posture, movement, and/or positioning may affect performance and/or development of "muscle memory" may enhance performance. Examples of such sports and/or activities include but are not limited to: golf, baseball, softball, cricket, basketball, football, hockey, skiing, snow boarding, rowing sports, sailing, weightlifting, sprinting, running, jogging, walking, gymnastics, cycling, skateboarding, soccer, swimming, diving, tennis, yoga, dance, volleyball, bobsledding, luge, lacrosse, etc.

We claim:

1. An article of apparel, comprising:

a garment structure for covering at least a portion of a human torso, wherein the garment structure is structured and arranged so as to provide a close fit to at least some of the human torso;

a first component engaged with the garment structure, wherein the first component comprises a first material layer having a resistance to stretch that is greater than a resistance to stretch of a material making up a majority of the garment structure, wherein the first component includes: (a) a first base area extending along a first side of a central spine region of the garment structure, and (b) a first plurality of vertically separated legs extending from the first base area, along a back region of the garment structure, and toward a first side of the garment structure; and a second component engaged with the garment structure, wherein the second component comprises a second material layer having a resistance to stretch that is greater than the resistance to stretch of the material making up the majority of the garment structure, wherein the second component includes: (a) a second base area extending along a second side of the central spine region of the garment structure and spaced from the first base area, and (b) a second plurality of vertically separated legs extending from the second base area, along the back region of the garment structure, and toward a second side of the garment structure;

wherein the first plurality of vertically separated legs extend around the first side to a central front region of the garment structure, and wherein the second plurality of vertically separated legs extend around the second side to the central front region of the garment structure.

2. The article of apparel according to claim 1, wherein the garment structure constitutes a shirt.

3. The article of apparel according to claim 1, wherein the garment structure constitutes a shirt, a blouse, or a tank top.

4. The article of apparel according to claim 1, wherein each of the first material layer and the second material layer is engaged with the garment structure by an adhesive or by application of heat and pressure.

5. The article of apparel according to claim 1, wherein each of the first material layer and the second material layer comprises a thermoplastic polymeric material.

6. The article of apparel according to claim 1, wherein the material making up the majority of the garment structure comprises an elastomeric material or a polyester material.

7. The article of apparel according to claim 6, wherein each of the first material layer and the second material layer is engaged with the garment structure by an adhesive or by application of heat and pressure.

8. The article of apparel according to claim 6, wherein each of the first material layer and the second material layer comprises a thermoplastic polymeric material.

9. The article of apparel according to claim 1, wherein the first plurality of vertically separated legs have free ends that are vertically separated from one another, and wherein the second plurality of vertically separated legs have free ends that are vertically separated from one another.

10. An article of apparel, comprising:

a garment structure for covering at least a portion of a human torso, wherein the garment structure is structured and arranged so as to provide a close fit to at least some of the human torso;

a first component engaged with the garment structure, wherein the first component comprises a first material layer having a resistance to stretch that is greater than a resistance to stretch of a material making up a majority of the garment structure, wherein the first component includes: (a) a first base area extending along a first side of a central spine region of the garment structure, and (b) a first plurality of vertically separated legs extending from the first base area, along a back region of the garment structure, and toward a first side of the garment structure, wherein one or more openings are defined in the first material layer; and a second component engaged with the garment structure, wherein the second component comprises a second material layer having a resistance to stretch that is greater than the resistance to stretch of the material making up the majority of the garment structure, wherein the second component includes: (a) a second base area extending along a second side of the central spine region of the garment structure and spaced from the first base area, and (b) a second plurality of vertically separated legs extending from the second base area, along a back region of the garment structure, and toward a second side of the garment structure, wherein one or more openings are defined in the second material layer;

wherein the first plurality of vertically separated legs extend around the first side to a central front region of the garment structure, and wherein the second plurality of vertically separated legs extend around the second side to the central front region of the garment structure.

11. The article of apparel according to claim 10, wherein the garment structure constitutes a shirt.

12. The article of apparel according to claim 10, wherein the garment structure constitutes a shirt, a blouse, or a tank top.

13. The article of apparel according to claim 10, wherein each of the first material layer and the second material layer is engaged with the garment structure by an adhesive or by application of heat and pressure.

14. The article of apparel according to claim 10, wherein each of the first material layer and the second material layer comprises a thermoplastic polymeric material.

15. The article of apparel according to claim 10, wherein the material making up the majority of the garment structure comprises an elastomeric material or a polyester material.

16. The article of apparel according to claim 10, wherein the first plurality of vertically separated legs have free ends that are vertically separated from one another, and wherein the second plurality of vertically separated legs have free ends that are vertically separated from one another.

17. An article of apparel, comprising:

a garment structure for covering at least a portion of a human torso, wherein the garment structure is structured and arranged so as to provide a close fit to at least some of the human torso;

a first component engaged with the garment structure, wherein the first component comprises a first material layer having a resistance to stretch that is greater than a resistance to stretch of a material making up a majority of the garment structure, wherein the first component includes: (a) a first base area extending along a first side of a central back region of the garment structure, and (b) a first plurality of vertically separated legs extending from the first base area toward a first side of the garment structure, wherein one or more openings are defined in the first material layer, and wherein the first component further includes a second material layer covering the one or more openings defined in the first material layer; and a second component engaged with the garment structure, wherein the second component comprises a third material layer having a resistance to stretch that is greater than the resistance to stretch of the material making up the majority of the garment structure, wherein the second component includes: (a) a second base area extending along a second side of the central back region of the garment structure and spaced from the first base area, and (b) a second plurality of vertically separated legs extending from the second base area toward a second side of the garment structure, wherein one or more openings are defined in the third material layer, and wherein the second component further includes a fourth material layer covering the one or more openings defined in the third material layer.

18. An article of apparel, comprising:

a garment structure for covering at least a portion of a human torso, wherein the garment structure is structured and arranged so as to provide a close fit to at least some of the human torso;

a first component engaged with the garment structure, wherein the first component comprises a first material layer having a resistance to stretch that is greater than a resistance to stretch of a material making up a largest proportion of the garment structure, wherein the first component includes: (a) a first base area extending along a first side of a central spine region of the garment structure, and (b) a first plurality of vertically separated legs extending from the first base area, along a back region of the garment structure, and toward a first side of the garment structure; and a second component engaged with the garment structure, wherein the second component comprises a second material layer having a resistance to stretch that is greater than the resistance to stretch of the material making up the largest proportion of the garment structure, wherein the second component includes: (a) a second base area extending along a second side of the central spine region of the garment structure and spaced from the first base area, and (b) a second plurality of vertically separated legs extending from the second base area, along the back region of the garment structure, and toward a second side of the garment structure;

wherein the first plurality of vertically separated legs extend around the first side to a central front region of the garment structure, and wherein the second plurality of vertically separated legs extend around the second side to the central front region of the garment structure.

* * * * *